US010520890B2

(12) United States Patent
Semon et al.

(10) Patent No.: US 10,520,890 B2
(45) Date of Patent: Dec. 31, 2019

(54) TIMEPIECE REGULATOR, TIMEPIECE MOVEMENT AND TIMEPIECE HAVING SUCH A REGULATOR

(71) Applicant: LVMH SWISS MANUFACTURES SA, La Chaux-de-Fonds (CH)

(72) Inventors: Guy Semon, Neuchatel (CH); Wout Johannes Benjamin Yoma, Delft (NL); Sybren Lennard Weeke, Blijham (NL); Nima Tolou, The Hague (NL)

(73) Assignee: LVMH SWISS MANUFACTURES SA, La Chaux-de-Fonds (CH)

( * ) Notice: Subject to any disclaimer, the term of this patent is extended or adjusted under 35 U.S.C. 154(b) by 0 days.

(21) Appl. No.: 15/532,448

(22) PCT Filed: Nov. 30, 2015

(86) PCT No.: PCT/EP2015/078017
§ 371 (c)(1),
(2) Date: Jun. 1, 2017

(87) PCT Pub. No.: WO2016/091632
PCT Pub. Date: Jun. 16, 2016

(65) Prior Publication Data

US 2017/0269551 A1 Sep. 21, 2017

(30) Foreign Application Priority Data

Dec. 9, 2014 (EP) ..... 14197019

(51) Int. Cl.
*G04B 15/00* (2006.01)
*G04B 17/04* (2006.01)
*G04B 15/02* (2006.01)

(52) U.S. Cl.
CPC ..... *G04B 17/045* (2013.01); *G04B 15/02* (2013.01)

(58) Field of Classification Search
CPC ..... G04B 15/02; G04B 15/06; G04B 15/08; G04B 15/14; G04B 17/04; G04B 17/045
See application file for complete search history.

(56) References Cited

U.S. PATENT DOCUMENTS 8,303,167 B2 * 11/2012 Dehon ..... G04B 17/045 368/127
8,882,339 B2 * 11/2014 Colpo ..... G04B 15/06 368/127
9,075,394 B2 7/2015 Stranczl et al.
9,207,640 B2 12/2015 Stranczl et al.
9,304,493 B2 4/2016 Stranczl et al.
9,310,771 B2 * 4/2016 Stranczl ..... G04B 15/12
(Continued)

FOREIGN PATENT DOCUMENTS

EP 2 613 205 A2 7/2013
EP 2 645 189 A1 10/2013

OTHER PUBLICATIONS

International Search Report related to Application No. PCT/FR2015/078017; dated Mar. 4, 2016.

*Primary Examiner* — Sean P Kayes
(74) *Attorney, Agent, or Firm* — Miller, Matthias & Hull LLP

(57) ABSTRACT

A timepiece regulator comprising an inertial regulating member which is mounted on a support by an elastic suspension so as to be able to oscillate in translation, along a main direction of translation.

13 Claims, 21 Drawing Sheets

(56) References Cited

U.S. PATENT DOCUMENTS

| | | | | |
|---|---|---|---|---|
| 9,477,205 | B2 * | 10/2016 | Born | G04B 17/045 |
| 9,785,116 | B2 * | 10/2017 | Winkler | G04B 17/20 |
| 2013/0176829 | A1 | 7/2013 | Cusin et al. | |
| 2015/0063082 | A1 * | 3/2015 | Stranczl | G04B 15/00<br>368/127 |
| 2015/0203985 | A1 * | 7/2015 | Stranczl | G04B 15/12<br>117/9 |
| 2015/0220060 | A1 * | 8/2015 | Laesser | G04B 15/08<br>368/127 |
| 2016/0313704 | A1 * | 10/2016 | Stranczl | G04B 15/14 |
| 2016/0327909 | A1 * | 11/2016 | Henein | G04B 17/045 |

* cited by examiner

TIMEPIECE REGULATOR, TIMEPIECE MOVEMENT AND TIMEPIECE HAVING SUCH A REGULATOR

CROSS-REFERENCE TO RELATED APPLICATION

This Application is a 35 USC § 371 US National Stage filing of International Application No. PCT/EP2015/078017 filed on Nov. 30, 2015, and claims priority under the Paris Convention to European Patent Application No. 14197019.4 filed on Dec. 9, 2014.

FIELD OF THE DISCLOSURE

The invention relates to timepiece regulators, to timepiece movements and timepieces having such regulators.

BACKGROUND OF THE DISCLOSURE

Document US2013176829A1 discloses a timepiece regulator, comprising at least one inertial regulating member which is mounted on a support by an elastic suspension so as to be able to oscillate.

One drawback of this timepiece regulator is that the amplitude of oscillation is limited by the geometry of the regulating member, of the support and of the elastic suspensions.

SUMMARY OF THE DISCLOSURE

One objective of the present invention is to at least mitigate this drawback.

To this end, according to an embodiment of the invention, the regulating member is mounted on the support to oscillate in translation, along a main direction of translation.

Thanks to these dispositions, there is more freedom to have the regulating member oscillate with higher amplitude compared to the rotary oscillator of US2013176829A1. The invention may also help enhancing linearity of the mechanical oscillator constituted by the regulator mechanism.

It should be noted that the invention as defined above is not limited to a monolithic design as that of the embodiments which will be described in more details below.

In various embodiments of the mechanism according to the invention, one may possibly have recourse in addition to one and/or other of the following arrangements:

- the regulating member is mounted on the support to oscillate in substantially rectilinear translation;
- the regulating member is mounted on the support to oscillate in circular translation, with a first amplitude of oscillation in the main direction of translation and a non-zero, second amplitude of oscillation in a secondary direction perpendicular to the main direction of translation, the first amplitude being larger than the second amplitude;
- the first amplitude of oscillation is at least 10 times larger than the second amplitude;
- said suspension includes at least two elastic links extending substantially in the second direction;
- the timepiece regulator comprises two inertial regulating members which are linked together such that said regulating members always have symmetrical an opposed movements in the main direction of translation;

- the two inertial regulating members are linked together by a balance lever which is pivotally mounted with respect to the support;
- the timepiece regulator is monolithic and made in a single plate.

Besides, the invention also concerns a timepiece movement having a timepiece regulator as defined above. The timepiece movement may further comprise a blocking mechanism which is controlled by the regulating member to regularly and alternatively hold and release a movable energy distribution member so that said energy distribution member moves by steps, said blocking mechanism being further adapted to regularly release energy to the regulating member for maintaining oscillation of said regulating member.

Further, the invention also concerns a timepiece having a timepiece movement as defined above.

BRIEF DESCRIPTION OF THE DRAWINGS

Other features and advantages of the invention appear from the following detailed description of several embodiments thereof, given by way of non-limiting example, and with reference to the accompanying drawings.

In the drawings.

DETAILED DESCRIPTION OF THE DISCLOSURE

In the Figures, the same references denote identical or similar elements.

Figure 1:
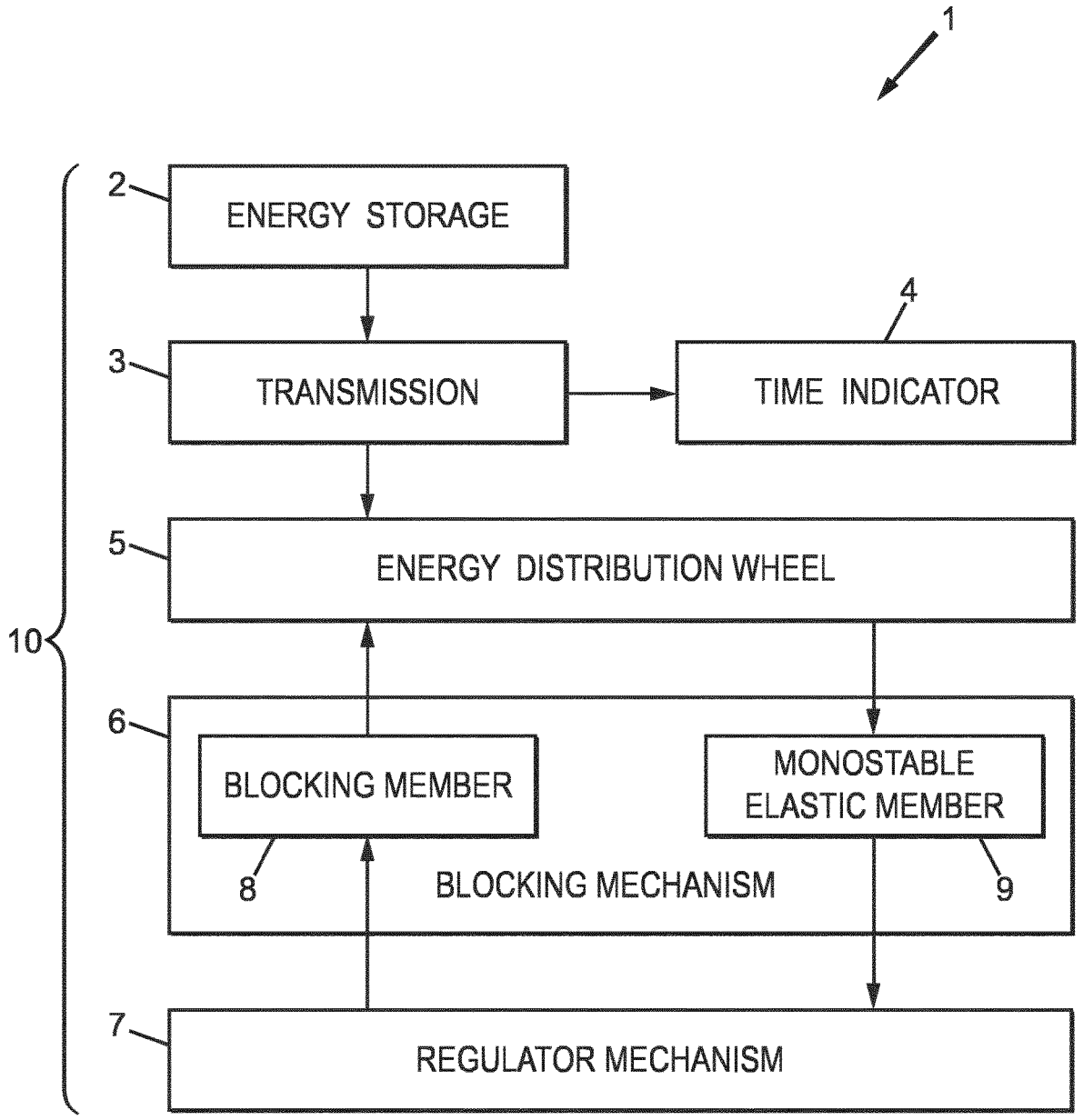
FIG. 1 is a schematic bloc diagram of a mechanical timepiece, according to the invention.

FIG. 1 shows a schematic bloc diagram of a mechanical timepiece 1, for instance a watch, including at least the following:

- a mechanical energy storage 2;
- a transmission 3 powered by the energy storage 2;
- one or several time indicator(s) 4, for instance watch hands driven by the transmission 3;
- an energy distribution member 5 driven by the transmission 3;
- a blocking mechanism 6 having for instance a blocking member 8 adapted to sequentially hold and release the energy distribution member 5 so that said energy distribution member may move step by step according to a repetitive movement cycle, of a constant travel at each movement cycle;

a regulator mechanism 7, which is an oscillating mechanism controlling the blocking mechanism to move it regularly in time so that the hold and release sequence of the blocking mechanism be of constant duration, thus giving the tempo of the movement of the energy distribution wheel 5, the transmission 3 and the time indicators 4.

The energy distribution member may be a rotary energy distribution wheel 5. The following description will be made with respect to such energy distribution wheel.

The mechanical energy storage 2 is usually a spring, for instance a spiral shaped spring usually called mainspring. This spring may be wound manually through a winding stem and/or automatically through an automatic winding powered by the movements of the user.

The transmission 3 is usually a gear comprising a series of gear wheels (not shown) meshing with one another and connecting an input shaft to an output shaft (not shown). The input shaft is powered by the mechanical energy storage 2 and the output shaft is connected to the energy distribution wheel. Some of the gear wheels are connected to the watch hands or other time indicators 4.

The transmission 3 is designed so that the energy distribution wheel rotates much more quickly than the input shaft (with a speed ratio which may be for instance of the order of 3000).

The regulator mechanism 7 is designed to oscillate with a constant frequency, thus ensuring the timepiece's precision. The oscillation of the regulator is sustained by regular transfers of mechanical energy from the energy distribution wheel 5, through a monostable elastic member 9 which may for instance belong to the blocking mechanism 6.

The mechanical energy storage 2, transmission 3, energy distribution wheel 5, blocking mechanism 6 and regulator 7 form together a timepiece movement 10.

The particular embodiment of FIGS. 2-9 will now be described in details.

Figure 2:
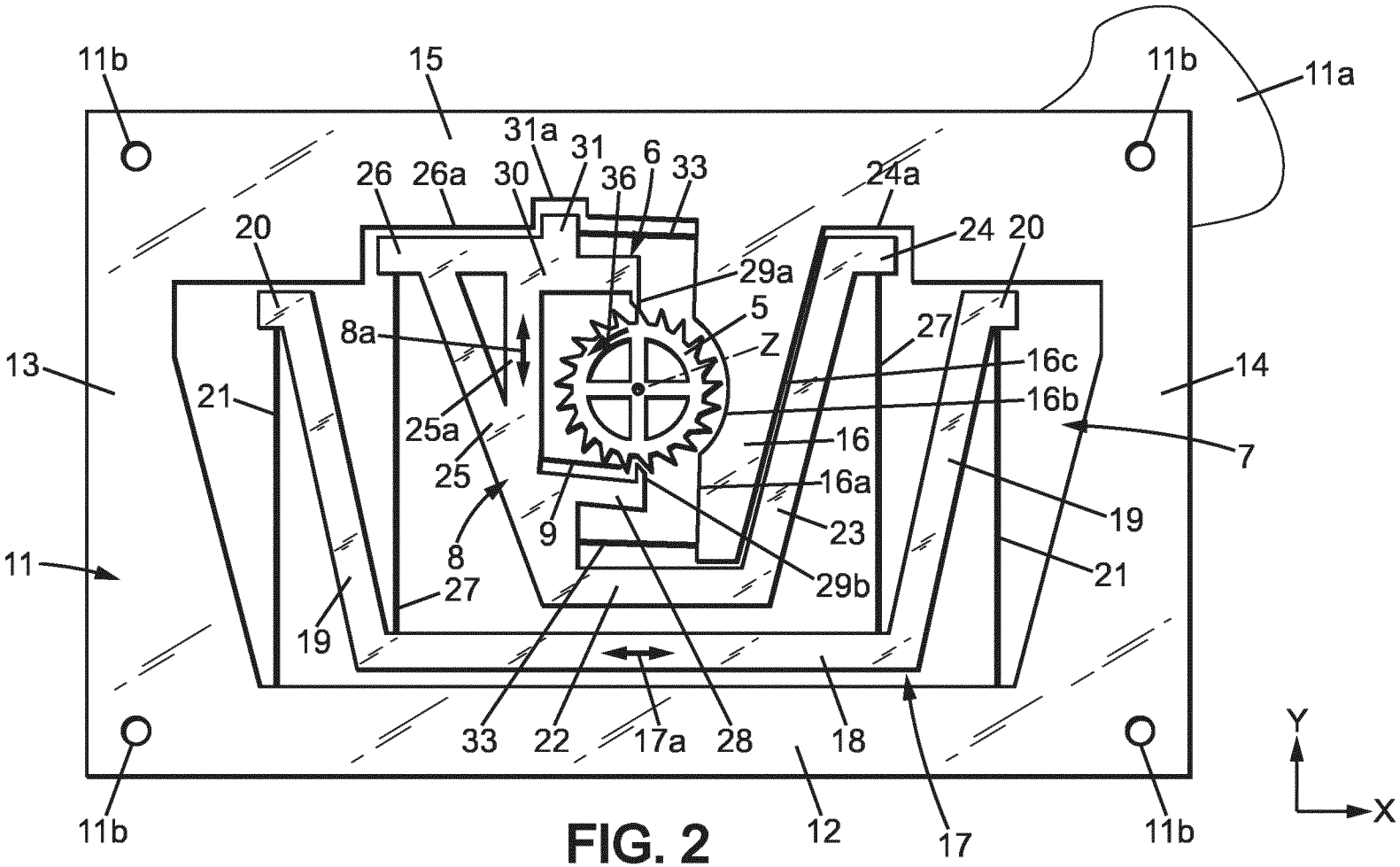
FIG. 2 is a plan view of a mechanism for a mechanical timepiece, including a regulator mechanism, a blocking mechanism and an energy distribution wheel according to a first embodiment of the invention.
Figure 2A:
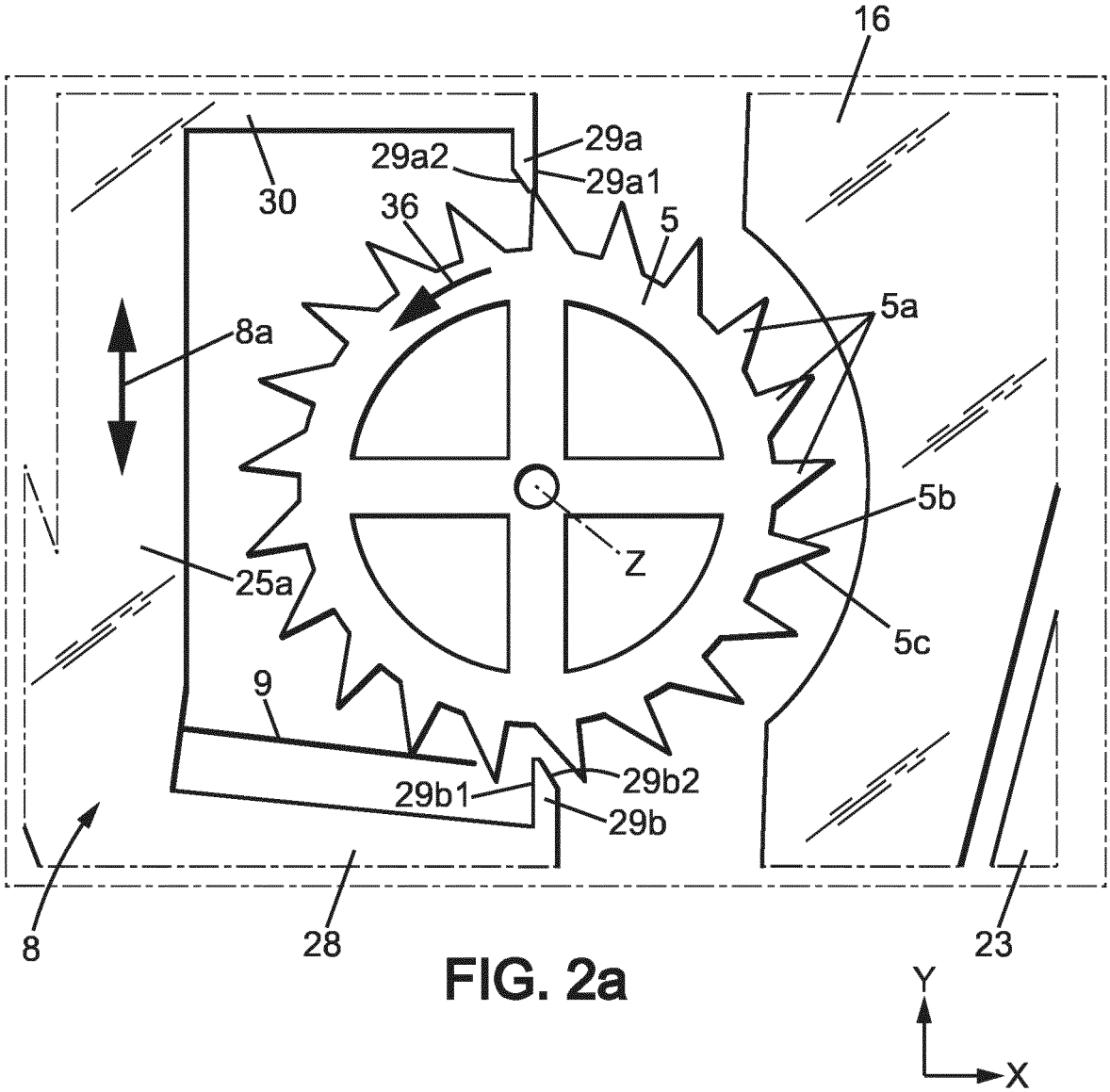
FIG. 2*a* shows details of the blocking mechanism and energy distribution wheel of FIG. 2.

In this embodiment, the blocking mechanism 6 and regulator mechanism 7 may be monolithic and made in a single plate 11, as shown for instance in FIGS. 2 and 2*a*. Plate 11 is usually planar.

The plate 11 may have a small thickness, e.g. about 0.1 to about 0.6 mm, depending of the material thereof.

The plate 11 may have transversal dimensions, in the plane of said plate (e.g. width and length, or diameter), comprised between about 15 mm and 40 mm.

The plate 11 may be manufactured in any suitable material, preferably having a relatively high Young modulus to exhibit good elastic properties. Examples of materials usable for plate 11 are: silicon, nickel, steel, titanium. In the case of silicon, the thickness of plate 11 may be for instance comprised between 0.3 and 0.6 mm.

The various members of the blocking mechanism 6 and regulator mechanism 7, which will be detailed hereafter, are formed by making cutouts in plate 11. These cutouts may be formed by any manufacturing method known in micromechanics, in particular for the manufacture of MEMS.

In the case of a silicon plate 11, plate 11 may be locally hollowed out for instance by Deep Reactive Ion Etching (DRIE), or in some cases by solid state laser cutting (in particular for prototyping or small series).

In the case of a nickel plate 11, the blocking mechanism 6 and regulator mechanism 7 may be obtained for instance by LIGA.

In the case of a steel or titanium plate 11, plate 11 may be locally hollowed out for instance by Wire Electric Discharge Machining (WEDM).

The constituting parts of the blocking mechanism 6 and regulator mechanism 7, each formed by portions of plate 11, by will now be described in details. Some of these parts are rigid and others are elastically deformable, usually in flexion. The difference between so-called rigid parts and so-called elastic parts is their rigidity in the plane of plate 11, due to their shape and in particular to their slenderness. Slenderness may be measured for instance by the slenderness ratio (ratio of length of the part on width of the part). Parts of high slenderness are elastic (i.e. elastically deformable) and parts of low slenderness are rigid. For instance, so-called rigid parts may have a rigidity in the plane of plate 11, which is at least about 1000 times higher than the rigidity of so-called elastic parts in the plane of plate 11. Typical dimensions for the elastic connections, e.g. elastic branches 21, 33 and elastic links 27 described below, include a length comprised for instance between 5 and 13 mm, and a width comprised for instance between 0.01 mm (10 μm) and 0.04 mm (40 μm), e.g. around 0.025 mm (25 μm).

Plate 11 forms an outer frame which is fixed to a support plate 11*a* for instance by screws or similar through holes 11*b* of the plate 11. The support plate 11*a* is in turn fixed in the timepiece casing.

In the example shown on FIG. 2, plate 11 forms a closed, rigid frame entirely surrounding the blocking mechanism 6 and regulator mechanism 7, but this frame could be designed otherwise and in particular could be designed to not surround or not surround totally the blocking mechanism 6 and regulator mechanism 7. In the example shown on FIG. 2, such fixed frame includes two substantially parallel sides 12, 15 extending in a first direction X and two substantially parallel sides 13, 14 extending in a second direction Y which is substantially perpendicular to the first direction X. Frame 12-15, support plate 11*a* and all other fixed parts may be referred to herein as "a support".

The energy distribution wheel 5 is pivotally mounted relative to the support, around an axis of rotation Z which is perpendicular to the plate 11. The energy distribution wheel 5 is biased by energy storage 2 through transmission 3 in a single direction of rotation 36.

The energy distribution wheel 5 has external teeth 5*a*, each having a front face 5*b* facing the direction of rotation 36 and a rear face 5*c* opposite the direction of rotation 36.

For instance, the front face 5*b* can extend in a radial plane which is parallel to the rotation axis Z, while the rear face 5*c* may extend parallel to axis Z and slantwise relative to the radial direction (see FIG. 2*a*).

It should be noted that the teeth 5*a* do not need to have the complex shape of a classical escapement wheel of a so-called Swiss-lever escapement or Swiss-anchor escapement.

The monostable elastic member 9 is linked to the regulator mechanism 7 and is adapted to bear on the teeth 5*a* of the energy distribution wheel 5. The monostable elastic member 9 normally have a first geometrical configuration (rest position) and the teeth 5*a* of the energy distribution wheel are adapted to elastically deform said monostable elastic member 9 by cam effect from said first geometrical configuration to a second geometrical configuration. The monostable elastic member 9 is arranged such that during each rotation cycle of the energy distribution wheel 5:

one tooth 5*a* of said energy distribution wheel elastically deforms said monostable elastic member 9 from said first geometrical configuration to said second geometrical configuration of the monostable elastic member;

and then said monostable elastic member 9 elastically returns to the first geometrical configuration, thereby releasing a predetermined amount of mechanical energy to the regulator mechanism 7.

The regulator mechanism may have a rigid, inertial regulating member 17 which is connected to the frame of the plate 11 by a first elastic suspension 21. The first elastic suspension may comprise for instance two flexible, first elastic branches 21 extending substantially parallel to the second direction Y, from the side 12 of the plate 11 so that the regulating member 17 is movable in translation substantially parallel to the first direction X with respect to the support. The regulating member 17 and the first elastic suspension 21 are arranged so that said regulating member 17 oscillates in two directions from the neutral position shown on FIG. 2, according to the double arrow 17*a* visible on FIG. 2, between two extreme positions which will be called here "first and second extreme regulating member positions".

The translation movement of regulating member 17 may be substantially rectilinear.

Advantageously, the regulating member 17 is mounted on the support to oscillate in circular translation, with a first amplitude of oscillation in the first direction X and a non-zero, second amplitude of oscillation in the second direction Y. Preferably, the first amplitude of oscillation is at least 10 times the second amplitude, which makes the movement substantially rectilinear.

The regulating member 17 may have a main rigid body 18 extending longitudinally substantially parallel to the first direction X close to the side 12 of plate 11, two diverging rigid arms 19 extending from the ends of the main body 18 toward the side 15 of plate 11, up to respective free ends 20. The free ends 20 may extend outwardly opposite to each other, substantially parallel to the first direction X.

The first elastic branches 21 may have first ends connected to the side 12 of plate 11, respectively close to sides 13, 14 of plate 11, and second ends respectively connected to the free ends 20 of the arms 19. The first elastic branches 21 may be substantially rectilinear (i.e. not flexed) when the regulating member 17 is at rest in the neutral position.

The length of first elastic branches 21 and the amplitude of oscillation of regulating member 17 are such that the movement of said regulating member 17 is substantially rectilinear, as explained above.

The blocking mechanism 6 has a rigid blocking member 8 which is connected to the regulating member 17 by at least an elastic link 27 so as to move in synchronism with said regulating member 17.

In the example shown on FIG. 2, the blocking member 8 may be connected to the regulating member 17 by two flexible elastic links 27 extending substantially parallel to the second direction Y. Said flexible elastic links 27 may be arranged to be substantially rectilinear (non-flexed) when the regulating member 17 is in neutral position.

The blocking member 8 may be mounted on the frame of the plate 11 by a second elastic suspension 33. The second elastic suspension 33 may be arranged to impose a translational movement to the blocking member 8 in the second direction Y. The second elastic suspension may comprise two flexible, second elastic branches 33 extending substantially parallel to the first direction X, so that blocking member 8 is movable in translation substantially parallel to the first direction X, in direction of double arrows 8*a*. The blocking member is thus movable in two opposite directions from a neutral position, between two extreme positions called here "first and second extreme blocking member positions". The elastic branches 33 may be arranged so as to be substantially linear (not flexed) when the blocking member 8 is at rest in the neutral position.

In the example shown on FIG. 2, the blocking member 8 may include:

a rigid base 22 close to the main body 18 of regulating member 17 and extending longitudinally in the first direction X, and two diverging rigid lateral arms 23, 25 from the ends of the base 22 toward the side 15 of plate 11, up to respective free ends 24, 26. The free ends 24, 26 may extend outwardly opposite to each other, substantially parallel to the first direction X.

The elastic links 27 may have first ends connected to main body of regulating member 18, close to the ends thereof, and second ends respectively connected to the free ends 24, 26 of the arms 23, 25.

Besides, the free end 26 of the lateral arm 25 may be extended toward the other lateral arm 23, in the first direction X, by a first transversal, rigid arm 30. The lateral arm 25 may also be extended, toward the other lateral arm 23, in the first direction X, by a second rigid transversal arm 28 which is close to the base 22. The energy distribution wheel 5 is between first and second transversal arms 30, 28.

The respective free ends of the first and second transversal arms 30, 28 may have respectively first and second stop members 29*a*, 29*b*. First and second stop members 29*a*, 29*b* may be in the form of rigid fingers protruding toward each other from the free ends of first and second transversal arms 30, 28, in the second direction Y.

First and second stop members 29*a*, 29*b* are designed to cooperate with the teeth 5*a* of the energy distribution wheel 5, as will be explained in more details below, to alternately hold and release said energy distribution wheel 5. First and second stop members 29*a*, 29*b* may have a stop face, respectively 29*a*1, 29*b*1, facing the front face 5*b* of the teeth, and an opposite rear face, respectively 29*a*2, 29*b*2. The stop faces 29*a*1, 29*b*1 may preferably be disposed in a radial plane parallel to axis Z, while the rear faces 29*a*2, 29*b*2 may extend slantwise so that the stop members 29*a*, 29*b* have pointed shapes.

Blocking member 8 may further include a strut 25*a*, extending in the second direction Y and joining the lateral arm 25 to the first transversal arm 30.

Blocking member 8 may further have a tab 31 extending in the second direction Y from the transversal arm 30, toward the side 15 of plate 11.

The free end 26 and first transversal arm 30 may be received with small play in an indent 26*a* cut out in the side 25 of plate 11. In addition, tab 31 may be received in a further indent 31*a* cut out in the side 15 of plate 11.

Plate 11 may further include a rigid tongue 16, extending in the second direction Y from the side 15 of plate 11 toward side 12, between the energy distribution wheel 5 and the lateral arm 23 of the blocking member 8. Tongue 16 may have a first edge 16*a* facing the energy distribution wheel 5 and extending parallel to the second direction Y. The first edge 16*a* may have a concave, circular cut out 16*b* partly receiving the energy distribution wheel 5. Tongue 16 further has a second edge 16*c* opposite the first edge and facing the lateral arm 23. The second edge 16*c* may be slanted parallel to the lateral arm 23, and be in close vicinity to lateral arm 23.

One of the second elastic branches 33 may have a first end connected to the first edge 16*a* of the tongue 16, close to the side 15 of plate 11, and a second end connected to the tab 31. The other of the second elastic branches 33 may have a first end connected to the first edge 16*a* of the tongue 16, close to the free end of the tongue 16, and a second end connected to the lateral arm 25 close to the base 22.

The blocking member 8 may be connected to the monostable elastic member 9. In particular, said monostable elastic member may be a flexible tongue 9 which has a first end connected to the blocking member 8 (and therefore linked to the regulator mechanism 7 through flexible links 27) and a second, free end bearing on the teeth 5*a* of the energy distribution wheel 5. Typical dimensions for the flexible tongue 9 include a length comprised between for instance 3 and 5 mm, and a width comprised for instance between 0.01 mm (10 μm) and 0.04 mm (40 μm), for instance around 0.025 mm (25 μm).

The flexible tongue 9 may be mounted on the blocking member 8 adjacent the second stop member 29*b*. In particular, the flexible tongue may be connected to the lateral arm 25 of the blocking member 8, close to the transversal arm 28. The flexible tongue 9 may extend substantially parallel to the first direction X, between the transversal arm 28 and the energy distribution wheel 5, up to a free end which is close to the second stop member 29*b*.

The flexible tongue 9 and blocking member 8 being two distinct members, the mechanism thus provides a separation between the function of blocking/releasing the distribution wheel 5 (provided by the blocking member 8) and the function of transferring energy to the regulator mechanism to sustain oscillation thereof (provided by the flexible tongue 9). Thanks to this separation of functions, the design of the blocking member 8 doesn't need to take into account the function of transferring energy (as it is the case in a traditional Swiss-anchor escapement which handles both blocking and energy transferring functions) and the design of the flexible tongue 9 doesn't need to take into account the function of blocking/releasing the distribution wheel 5.

During operation, regulating member oscillates in translation parallel to the first direction X, with a frequency f comprised for instance between 20 and 30 Hz, and blocking member 8 oscillates with a frequency 2f, twice the oscillation frequency of the regulating member 17.

More precisely, the elastic links 27 are arranged such that:

- the blocking member 8 is moved to the second extreme blocking member position by the elastic link 27 (toward the side 15) when the regulating member 17 is in the neutral position; and
- the blocking member 8 is moved to the first extreme blocking member position (toward the side 12) by the elastic links 27 when the regulating member 17 is in any of the first and second extreme regulating member positions.

During this movement, the first and second stop members 29*a*, 29*b* move substantially radially with regard to the energy distribution wheel 5, alternately toward and away from said energy distribution wheel, and the first and second stop members 29*a*, 29*b* thus interfere in turn with the teeth 5*a* of the energy distribution wheel 5 so as to hold said energy distribution wheel 5 respectively when said blocking member 8 is in the first and second extreme blocking member positions.

More precisely, the first stop member 29*a* is arranged to:

- hold the energy distribution wheel 5 when the blocking member is moving between the first extreme blocking member position (close to side 12) and a first escape position (position where the apex of first stop member 29*a* is in correspondence with the outer diameter of the teeth 5*a*),
- and not interfere with the energy distribution wheel 5 when the blocking member 8 is between said first escape position and the second extreme blocking member position (close to side 15).

Besides, the second stop member 29*b* is arranged to:

- hold the energy distribution wheel 5 when the blocking member is moving between the second extreme blocking member position (close to side 15) and a second escape position (position where the apex of second stop member 29*b* is in correspondence with the outer diameter of the teeth 5*a*);
- and not interfere with the energy distribution wheel 5 when the blocking member 8 is between said second escape position and the first extreme blocking member position (close to side 12).

Further, the second escape position of blocking member 8 may be between the first extreme blocking member position (close to side 12) and the first escape position. In that case, advantageously, the first and second stop members 29*a*, 29*b* are arranged such that:

- when said blocking member 8 is in the first escape position and the first stop member 29*a* is in correspondence with the front face 5*b* of a tooth 5*a*, the second stop member 29*b* is between two other teeth 5*a* of the energy distribution wheel, in the vicinity of the rear face 5*c* of one of these two other teeth;
- when said blocking member 8 is in the second escape position and the second stop member 29*b* is in correspondence with the front face 5*b* of a tooth 5*a*, the first stop member 29*a* is between two other teeth 5*a* of the energy distribution wheel, in the vicinity of the rear face 5*c* of one of these two other teeth.

The flexible tongue 9 may be arranged such that the teeth 5*a* of the energy distribution wheel 5 elastically deform said monostable elastic member 9 from said first geometrical configuration to said second geometrical configuration during rotation of the energy distribution wheel 5 when the blocking member 8 is between the first escape position and the second extreme blocking member position. Thus, the flexible tongue 9 accumulates a predetermined potential mechanical energy, corresponding to the geometrical deformation thereof between the predetermined first geometrical configuration and the predetermined second geometrical configuration. This predetermined energy is the same at each rotation cycle of the energy distribution wheel 5.

The flexible tongue 9 may be arranged such that said flexible tongue 9 is in the second geometrical configuration when the blocking member 8 is in the second extreme blocking member position. Thus, the flexible tongue 9 returns to the first geometric configuration and transfers said predetermined amount of mechanical energy to the blocking member 8 during movement of the blocking member 8 from the second extreme blocking member position to the second escape position. The elastic links 27 are arranged to transmit said predetermined amount of mechanical energy to the regulating member 17.

Further, the flexible tongue 9 may be arranged not to interfere with the teeth 5*a* of the energy distribution wheel 5 while the blocking member 8 moves from the second escape position to the first extreme blocking member position and from said first extreme blocking member position to the first escape position.

Preferably, the transmission 3 is such that each rotation step of the energy distribution wheel 5 is completed in a time which is not longer than the time necessary for the blocking member 8 to travel from the first escape position to the second extreme blocking member position.

The operation of the mechanism will now be described step by step, with regard to FIGS. 3, 3*a*-9, 9*a*.

Figure 3:
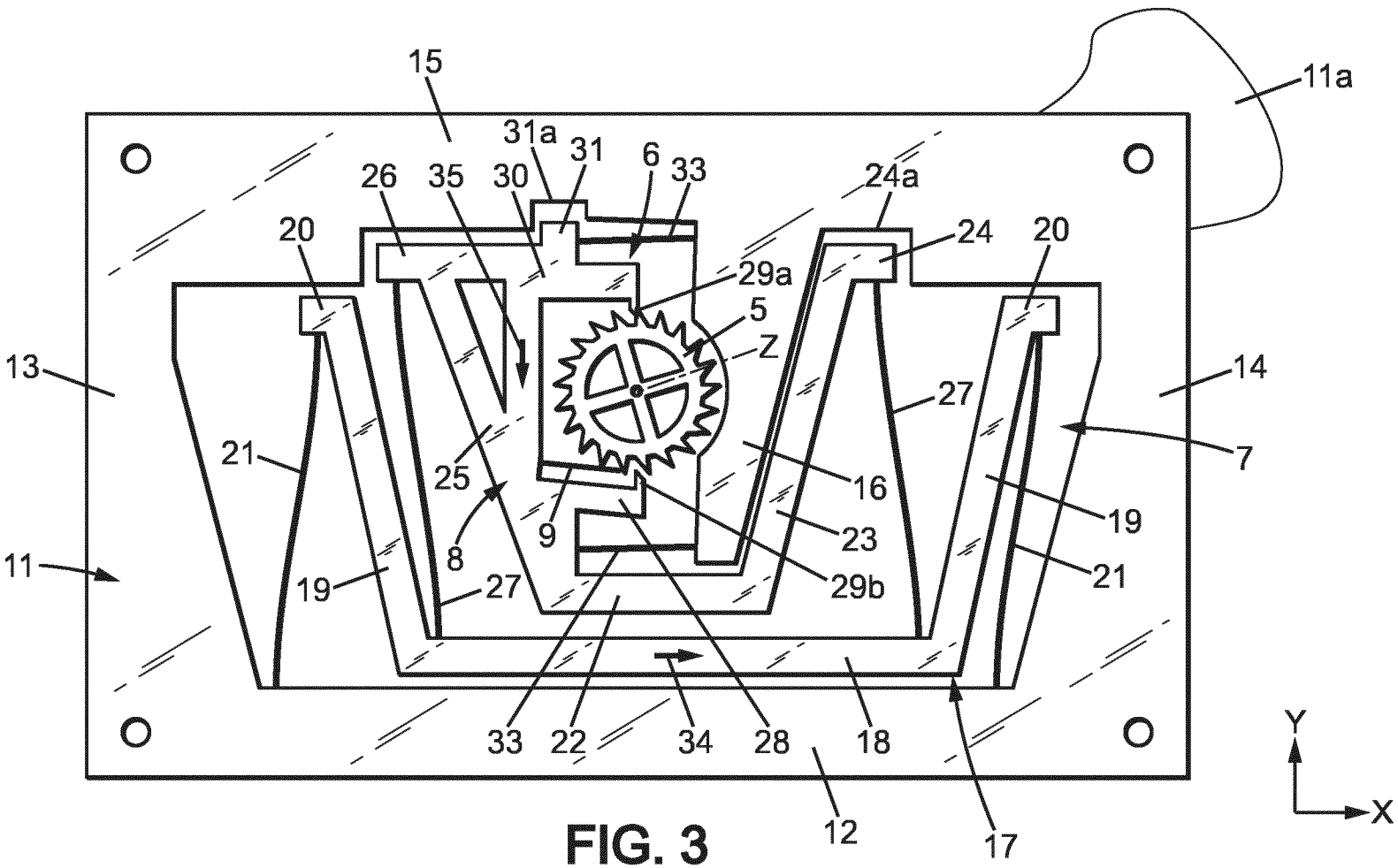
FIGS. 3,3*a* to 9,9*a* are views similar to FIGS. 2 and 2*a*, respectively illustrating successive movements of the mechanism of FIG. 2 in substantially half a period of the regulating mechanism.
Figure 3A:
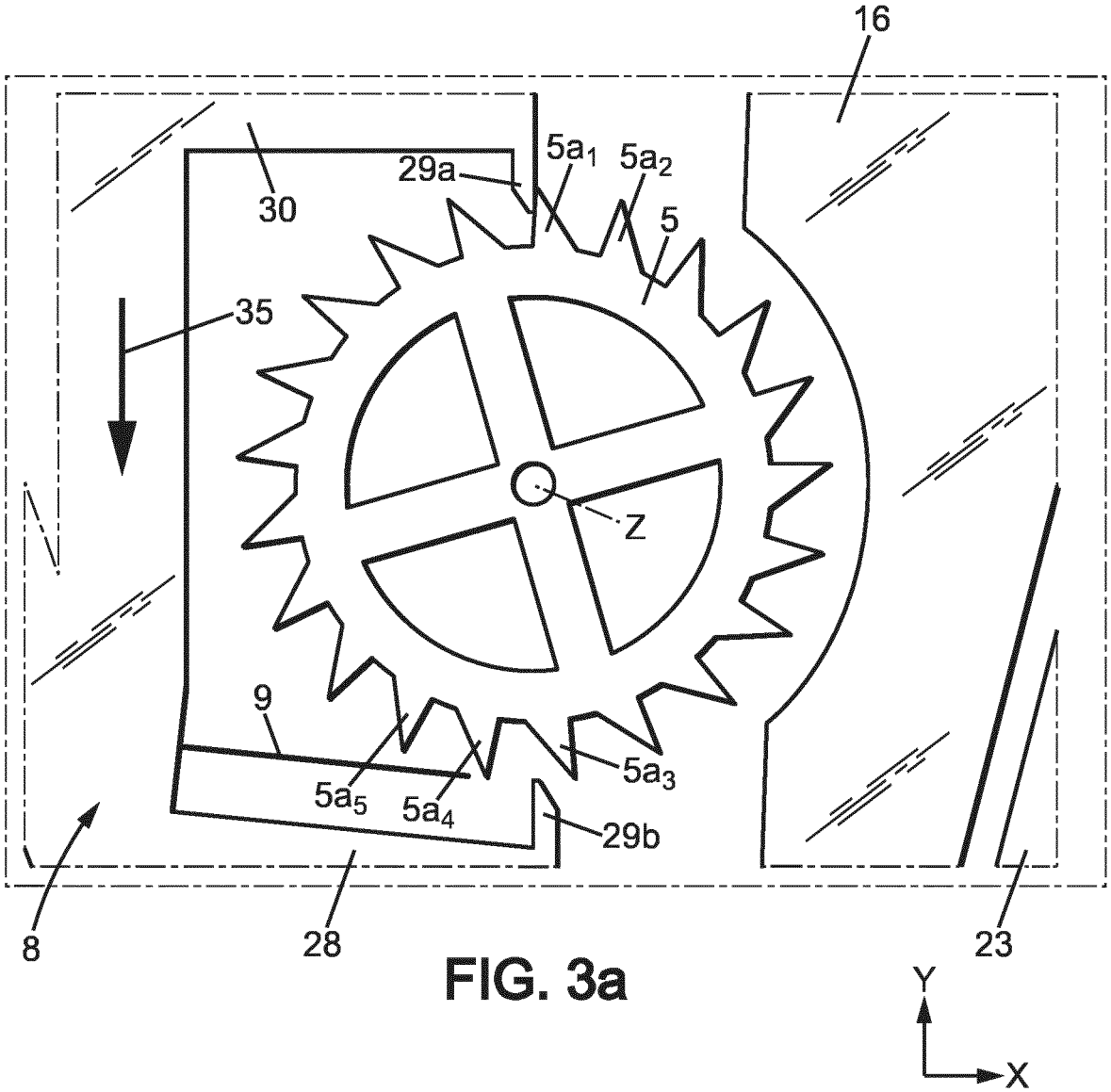

In the position of FIGS. 3 and 3*a:* regulating member 17 is moving toward side 14 in the direction of arrow 34 and is close to the second extreme regulating member position;

blocking member 8 is moving toward side 12 in the direction of arrow 35 and is close to the first blocking member regulating member position, so that energy distribution wheel 5 is held by the first stop member 29*a;* second stop member 29*b* does not interfere with the energy distribution wheel 5;

flexible tongue 9 is in the first geometric position (rest position).

For a better understanding, reference numerals have been given to some of the teeth 5*a* on FIGS. 3*a*-9*a*. The situation of these teeth is as follows in the position of FIG. 3*a:* tooth $5a_1$ is the tooth which is held by the first stop member 29*a;* tooth $5a_2$ is the next tooth which will move toward the first stop member 29*a* the direction of rotation at the next rotation step of the energy distribution wheel 5;

teeth $5a_3$ and $5a_4$ are situated respectively past and before the second stop member in the direction of rotation of the energy distribution wheel 5;

tooth $5a_4$ is the next tooth to move toward second stop member 29*b* after tooth $5a_4$ in the direction of rotation of the energy distribution wheel 5.

Figure 4:
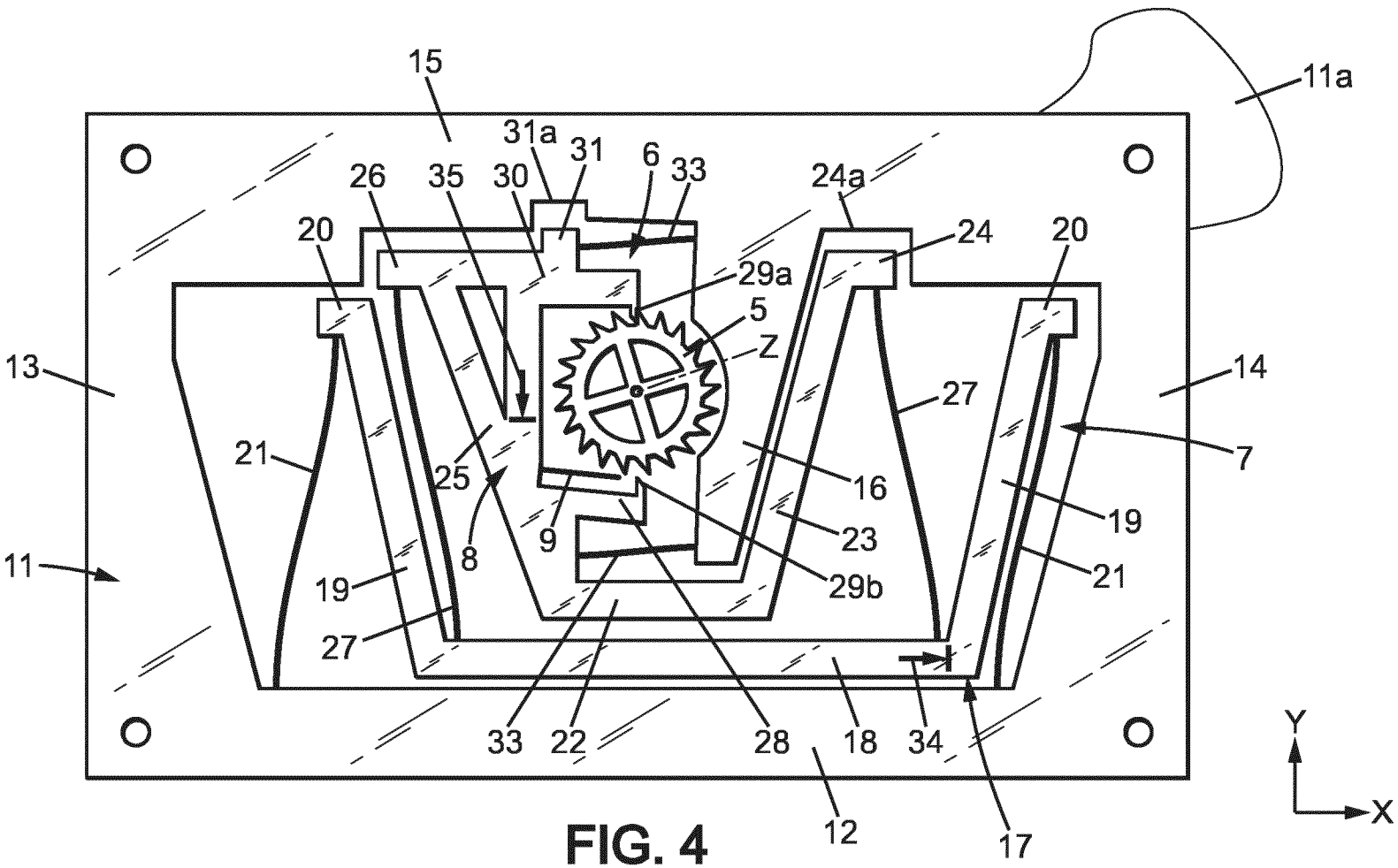
Figure 4A:
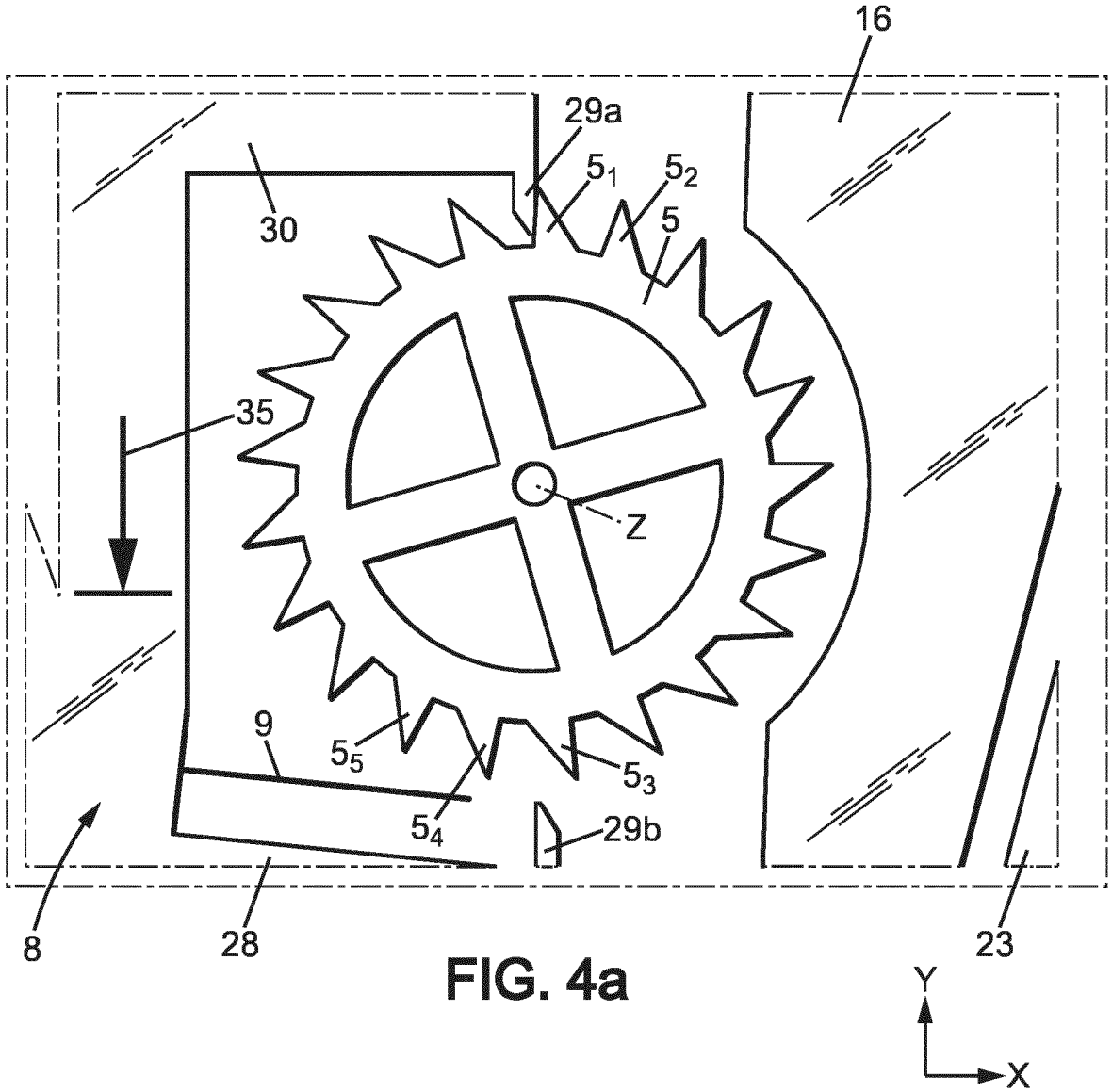

The mechanism then arrives in the position of FIGS. 4, 4*a*, where:

regulating member 17 arrives in the second extreme regulating member position;

blocking member 8 arrives in the first extreme blocking member position, and energy distribution wheel 5 is still held by the first stop member 29*a;* flexible tongue 9 is still in the first geometric position (rest position).

Figure 5:
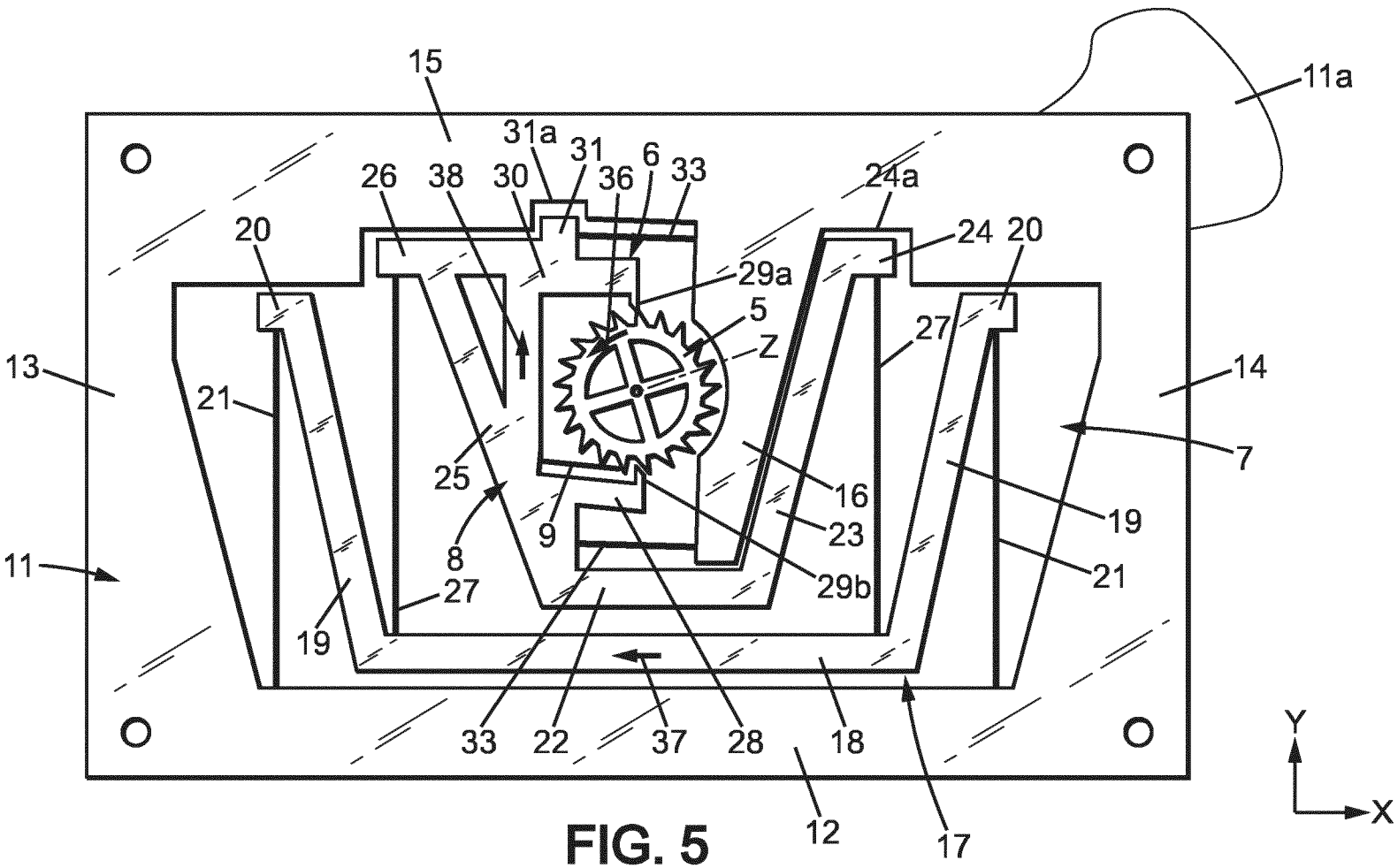
Figure 5A:
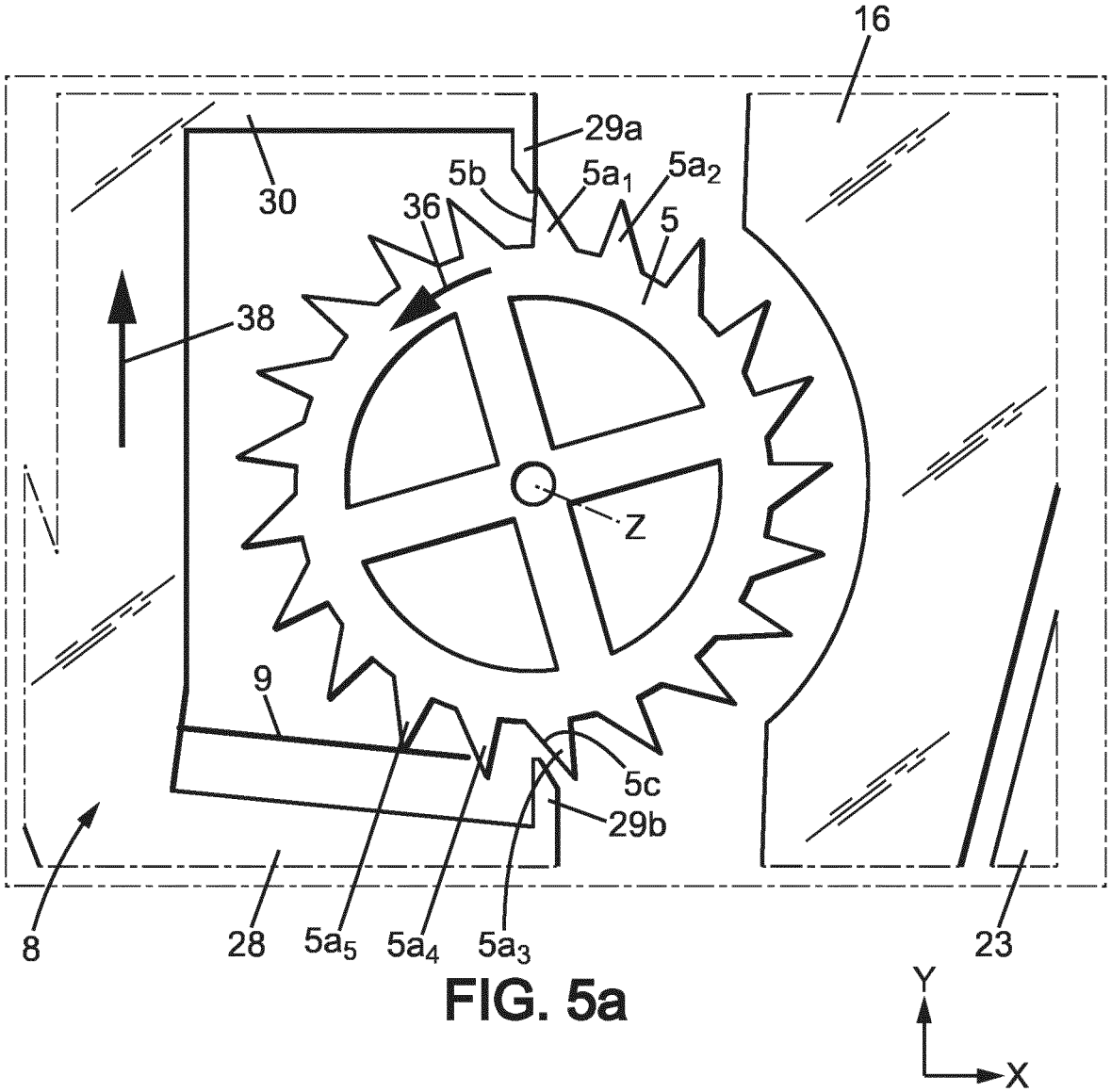

The regulating member 17 and blocking member 8 then change their direction of movement, and the mechanism arrives in the position of FIGS. 5, 5*a*, where:

regulating member 17 moves toward side 13 in the direction of arrow 37, and arrives close to neutral position;

blocking member 8 moves toward side 15 in the direction of arrow 38 and arrives in the first escape position where energy distribution wheel 5 will be released by the first stop member 29*a* and turn of one angular step in the direction of arrow 36;

second stop member 29*b* is already between two teeth 5*a* of the energy distribution wheel 5, close to the rear face 5*c* of one of these teeth 5*a;* flexible tongue 9 is beginning to be flexed by tooth $5a_5$ of the energy distribution wheel 5.

Figure 6:
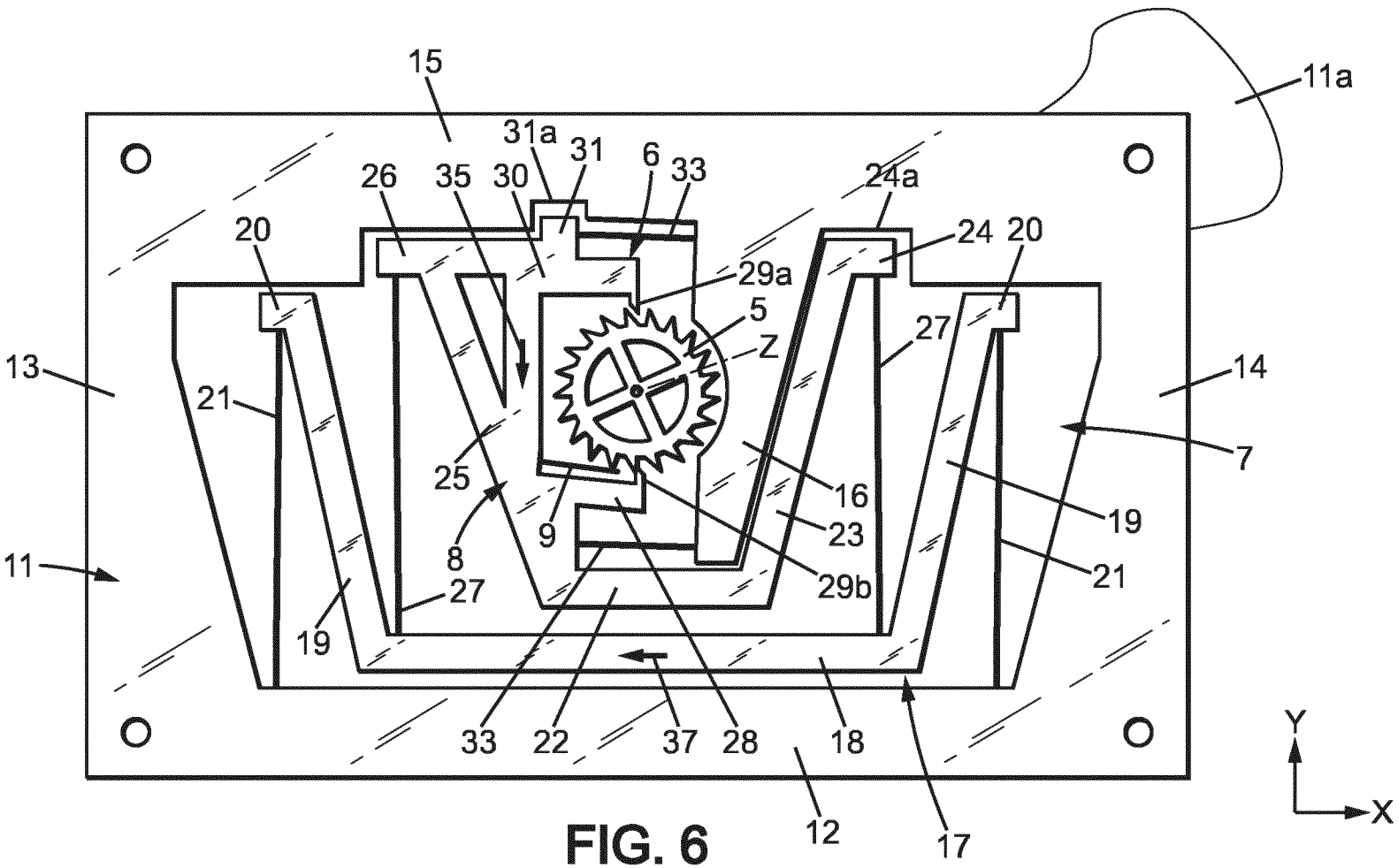
Figure 6A:
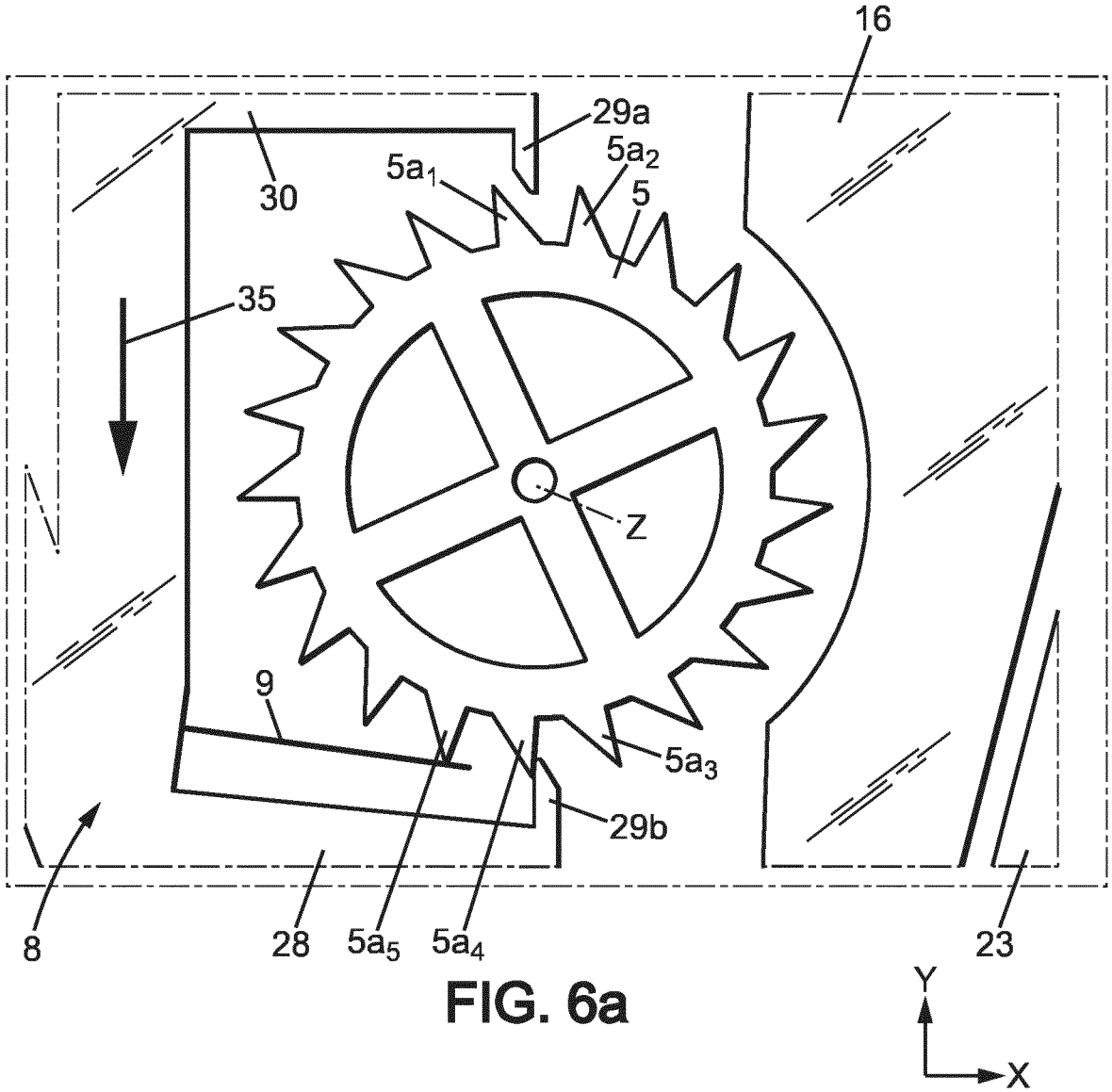

The energy distribution wheel 5 then quickly turns of one angular step and the mechanism arrives in the position of FIGS. 6, 6*a*, where:

regulating member 17 still moves toward side 13 in the direction of arrow 37, and is still close to neutral position;

blocking member 8 is close to the second blocking member and already moves toward side 12 in the direction of arrow 35;

first stop member 29*a* does not interfere with the energy distribution wheel 5 and is situated angularly between teeth $5a_1$ and $5a_2$;

second stop member 29*b* holds the energy distribution wheel 5 by abutment with the front face of tooth $5a_4$;

flexible tongue 9 is in the second geometrical configuration, flexed at the maximum by tooth $5a_5$, and is starting to progressively return to the first geometrical configuration, while releasing its energy to the blocking member 8 and the regulating member 17.

Figure 7:
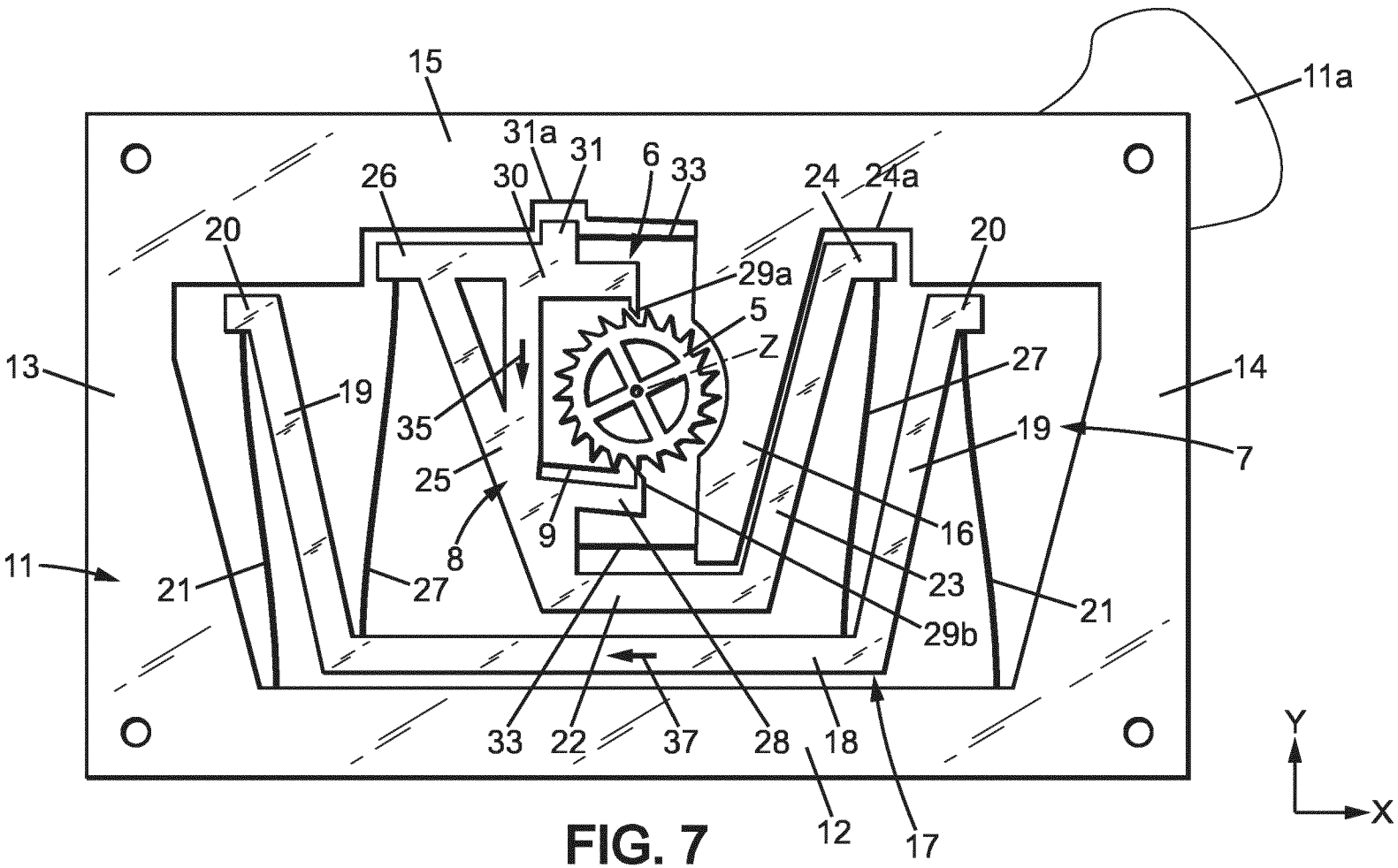
Figure 7A:
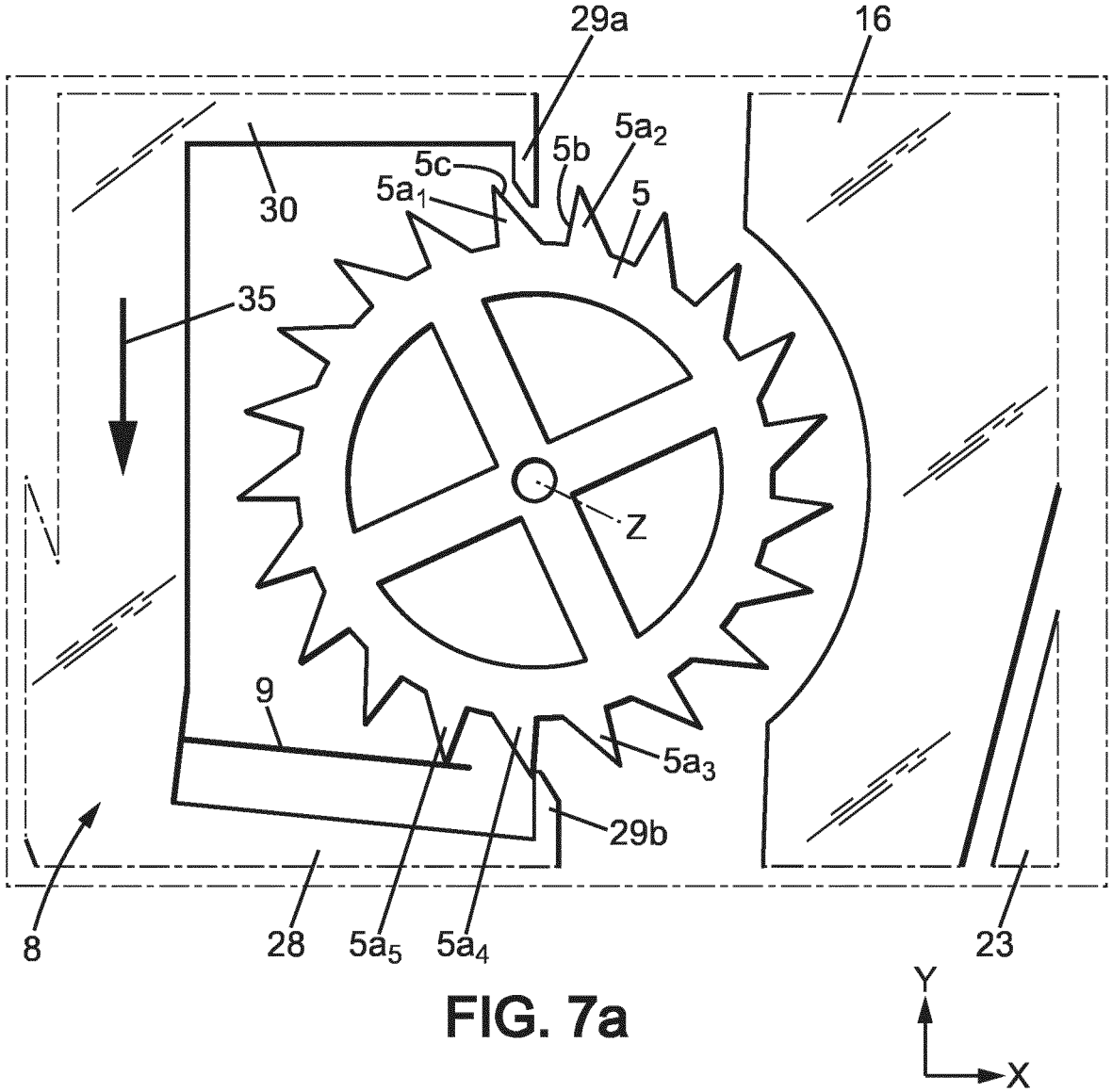

The mechanism then arrives in the position of FIGS. 7, 7*a*, where:

regulating member 17 still moves toward side 13 in the direction of arrow 37;

blocking member 8 still moves toward side 12 in the direction of arrow 35;

first stop member 29*a* is already between teeth 5*a*1 and $5a_2$ of the energy distribution wheel 5, close to the rear face 5*c* of tooth $5a_1$;

flexible tongue 9 has released its energy and has returned to the first (non-flexed) geometrical configuration.

Figure 8:
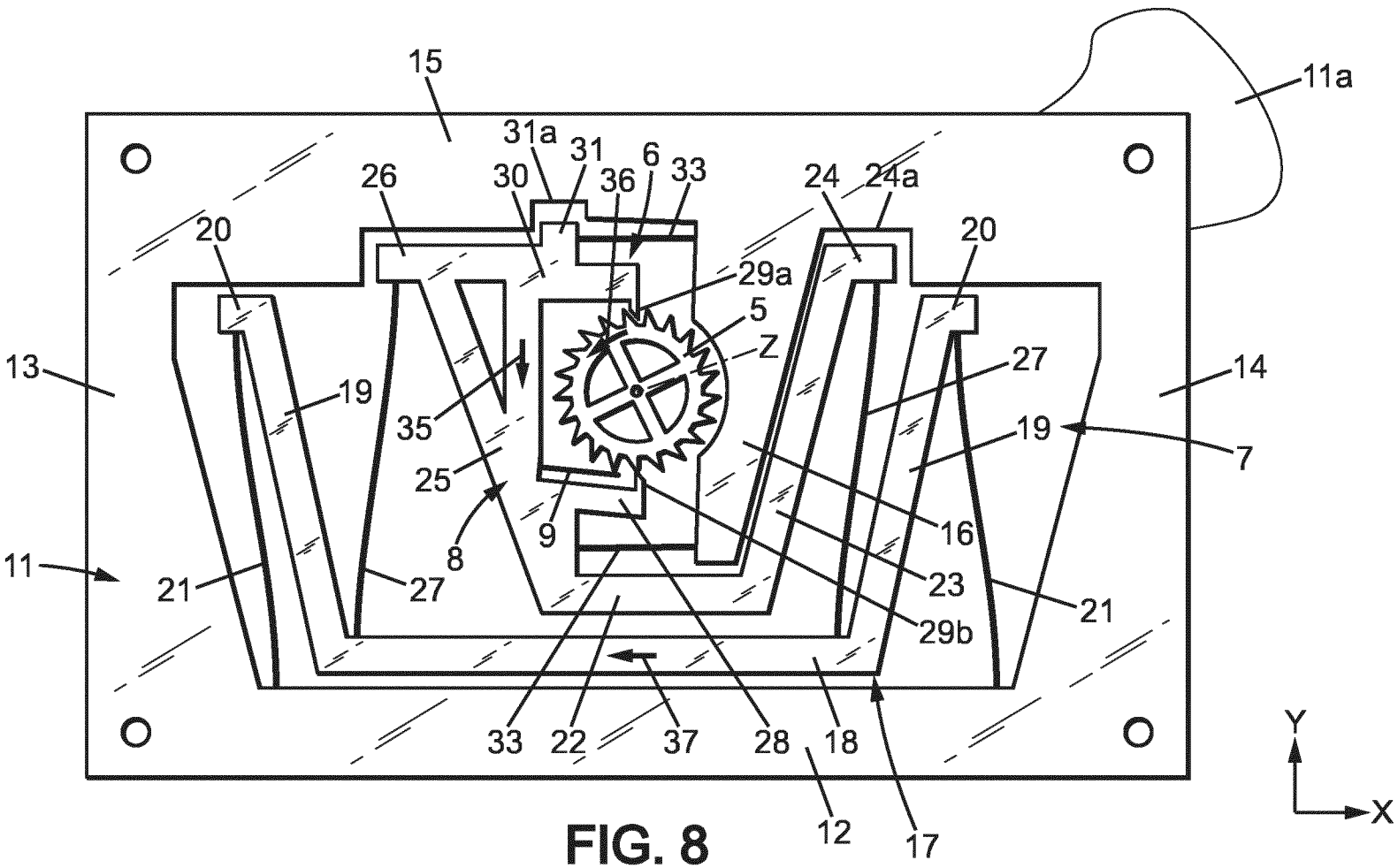
Figure 8A:
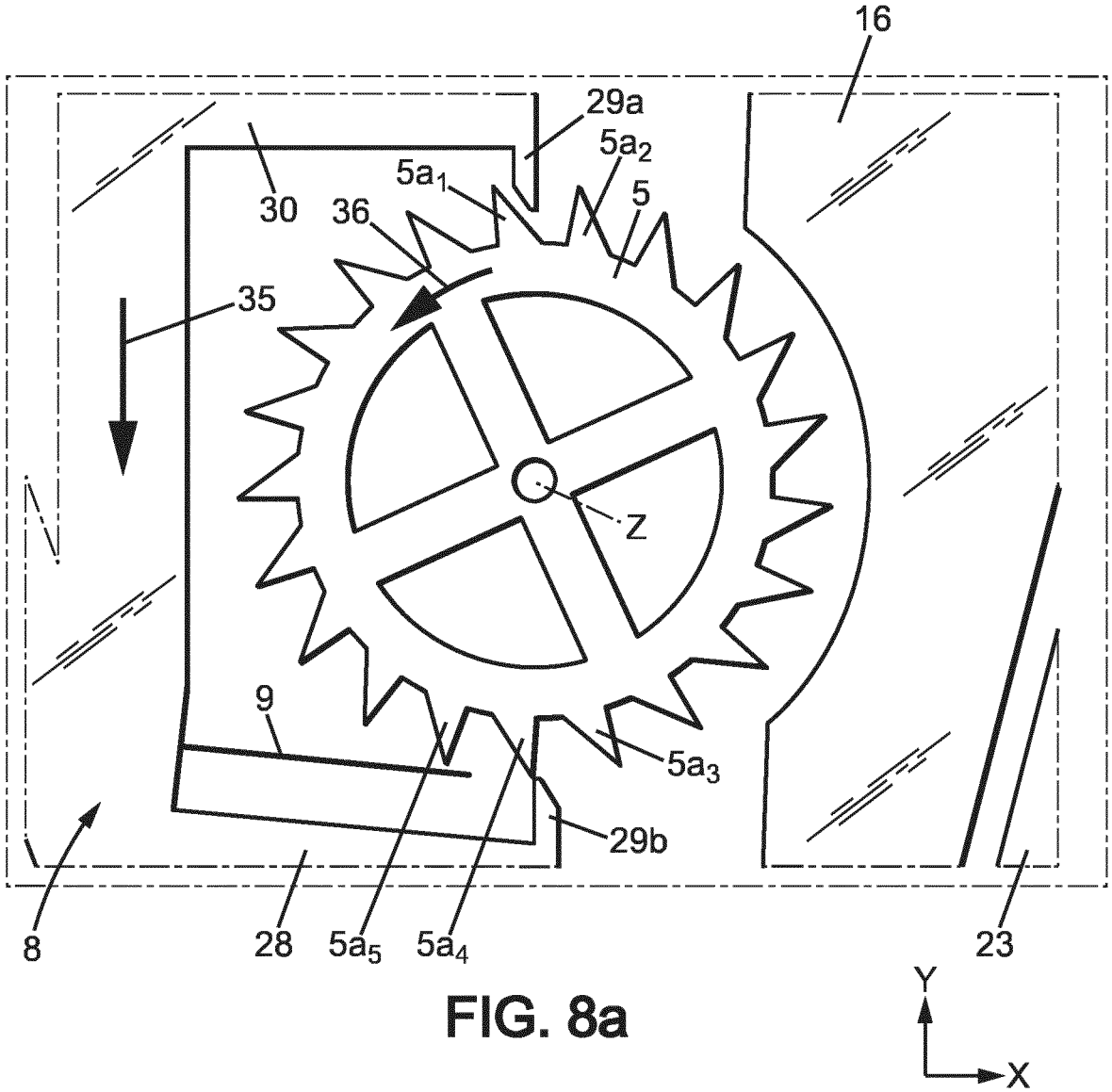

The mechanism then arrives in the position of FIGS. 8, 8*a*, where:

regulating member 17 still moves toward side 13 in the direction of arrow 37;

blocking member 8 still moves toward side 12 in the direction of arrow 35 and arrives in the second escape position where energy distribution wheel 5 will be released by the second stop member 29*b* and will turn of one angular step in the direction of arrow 36;

first stop member 29*a* is still between teeth 5*a*1 and $5a_2$ of the energy distribution wheel 5, close to the rear face 5*c* of tooth $5a_1$;

flexible tongue 9 is in the first (non-flexed) geometrical configuration.

Figure 9:
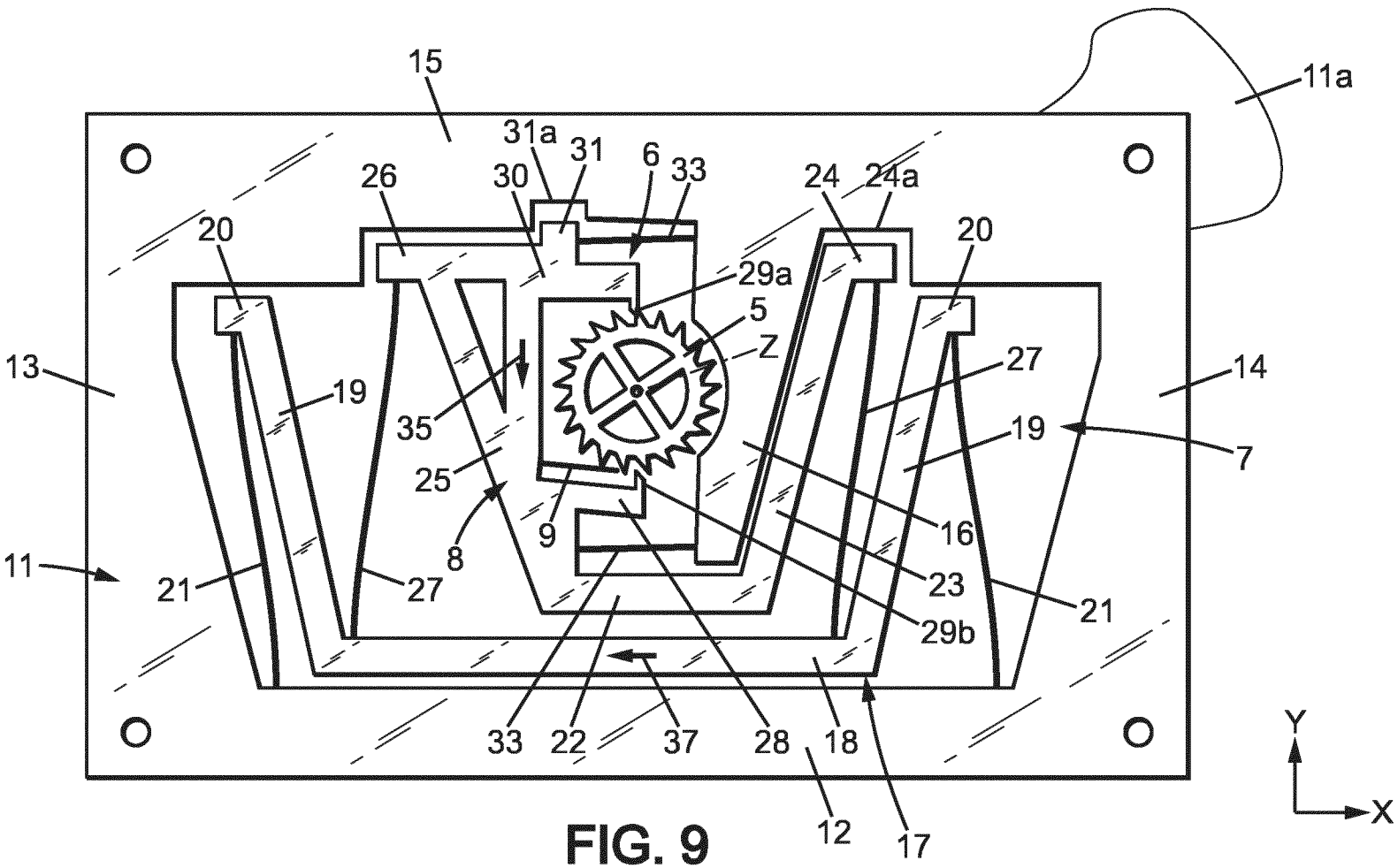
Figure 9A:
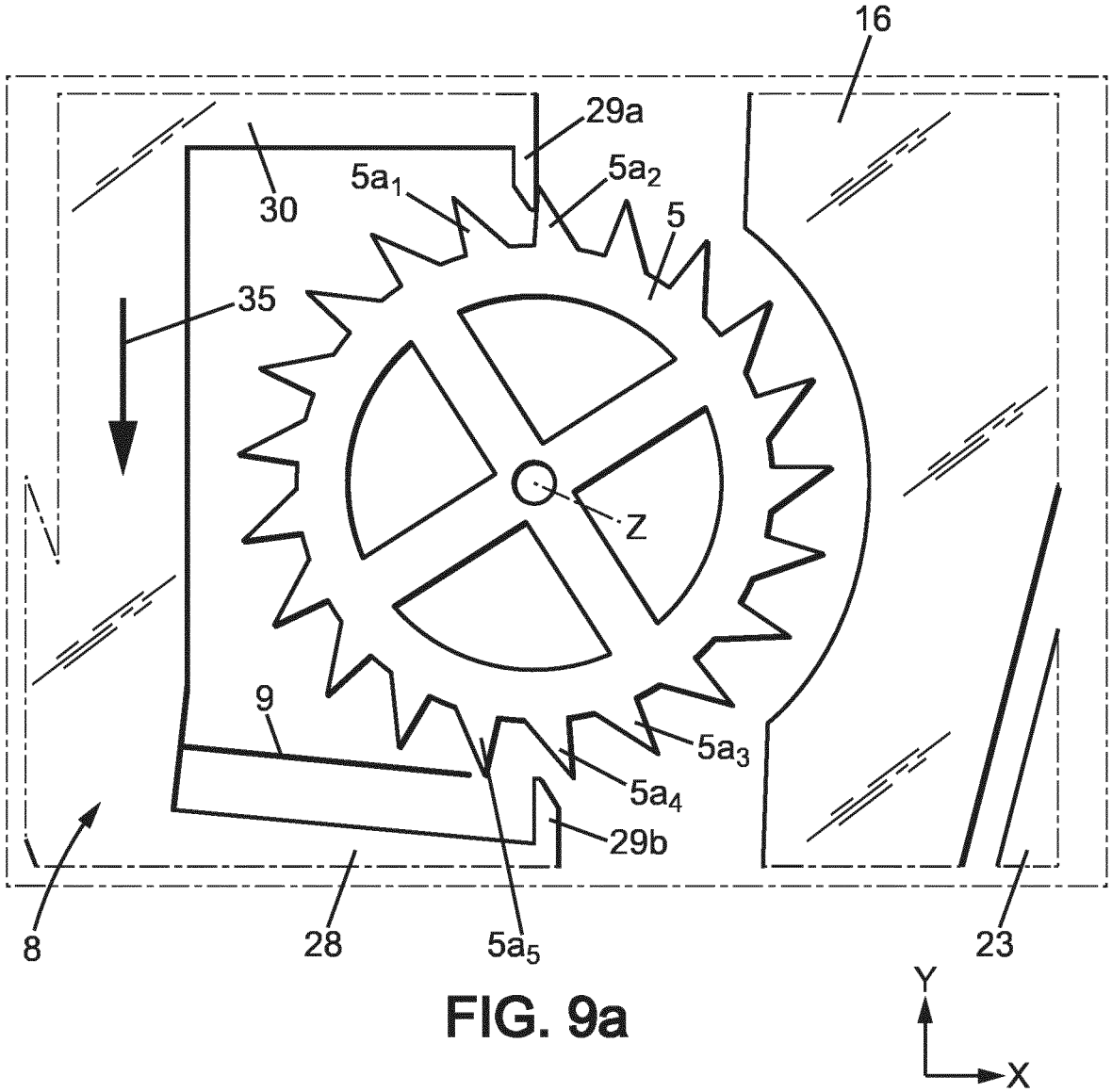

After the energy distribution wheel has turned of one angular step, the mechanism then arrives in the position of FIGS. 9, 9*a*, where:

regulating member 17 still moves toward side 13 in the direction of arrow 37, and is close to the first extreme regulating member position;

blocking member 8 still moves toward side 12 in the direction of arrow 35 and arrives close to the first extreme blocking member position;

energy distribution wheel 5 is held by the first stop member 29*a;* flexible tongue 9 is in the first (non-flexed) geometrical configuration.

The regulating member 17 and blocking member 8 then change direction and the same steps occur until the mechanism reaches back the position of FIGS. 3, 3*a*, and then the cycle is repeated.

Thus, the movement cycle of energy distribution wheel 5 includes two angular steps of rotation, each equivalent to half the angular extent of one tooth 5*a*. In the example of FIGS. 2-9, energy distribution wheel 5 has 21 teeth 5*a*, so that said angular step is $\alpha=360°/(21*2)-8.57°$. It should be noted that each movement cycle of energy distribution wheel 5 is completed during half an oscillation cycle of regulating member 17, so that the frequency of movements of energy distribution wheel 5 is 4 times the oscillation frequency of the regulator mechanism 7. Thus, if the frequency f of the regulator mechanism 7 is 30 Hz, then the frequency of the blocking member 8 will be 2f=60 HZ and the frequency of movements of energy distribution wheel 5 will be 4f=120 Hz.

The second embodiment of the invention will now be described with regard to FIGS. 10-13. The explanations of FIG. 1 still apply to this second embodiment.

Figure 10:
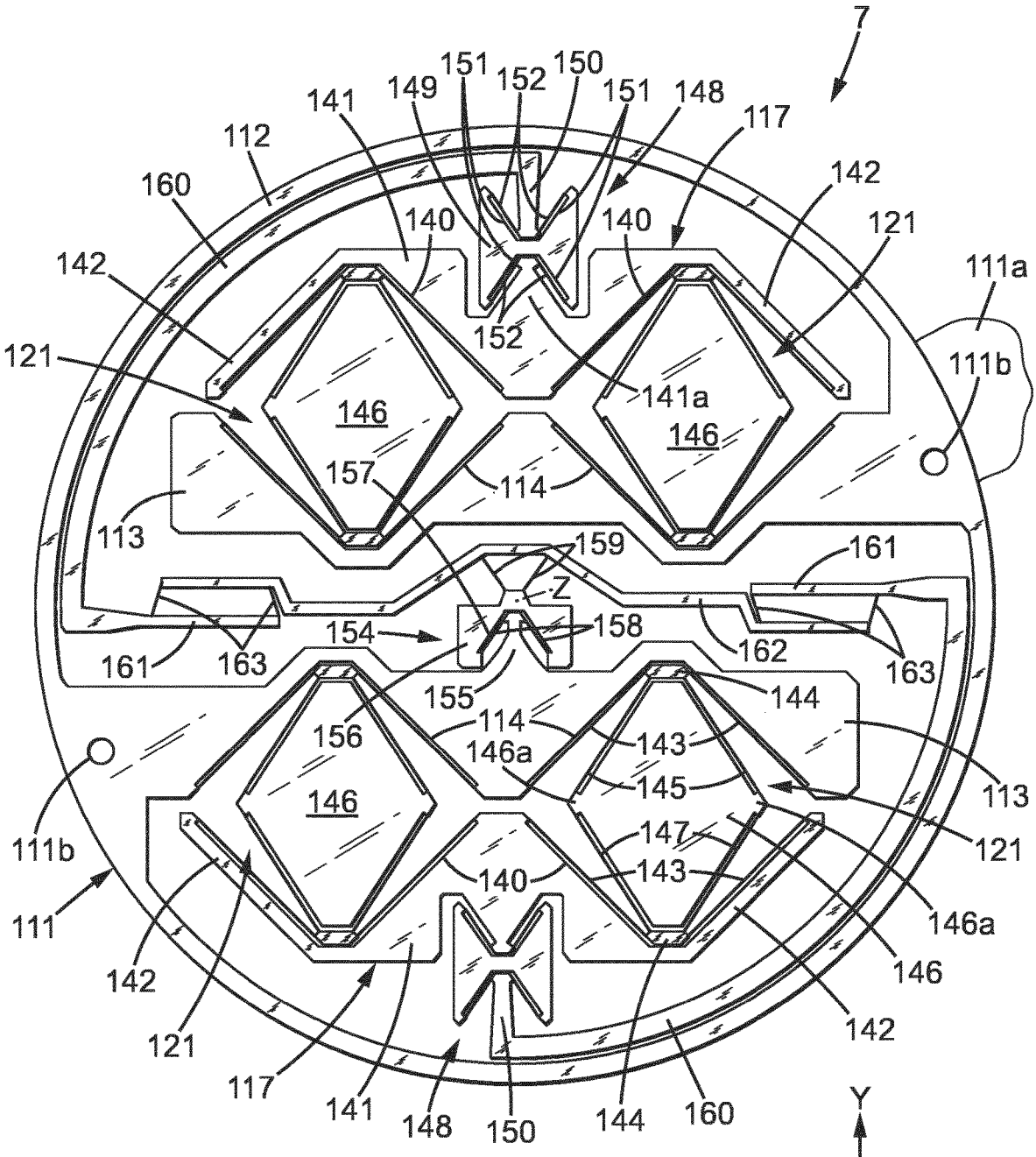
FIG. 10 is a plan view of a regulator mechanism for a mechanical timepiece according to a second embodiment of the invention, in rest position.

In this second embodiment, as shown in FIG. 10, regulator mechanism 7 may be monolithic and made in a single plate 111. Plate 111 is usually planar, extending parallel to two perpendicular directions X, Y.

The plate 111 may have a small thickness, e.g. about 0.1 to about 0.6 mm, depending of the material thereof.

The plate 111 may have transversal dimensions, in the plane of said plate (e.g. width and length, or diameter), comprised between about 15 mm and 40 mm.

The plate 111 may be manufactured in any suitable material, preferably having a relatively high Young modulus to exhibit good elastic properties. Examples of materials usable for plate 111 are: silicon, nickel, steel, titanium. In the case of silicon, the thickness of plate 111 may be for instance comprised between 0.3 and 0.6 mm.

The various members of regulator mechanism 7, which will be detailed hereafter, are formed by making cutouts in plate 111. These cutouts may be formed by any manufacturing method known in micromechanics, in particular for the manufacture of MEMS.

In the case of a silicon plate 111, plate 111 may be locally hollowed out for instance by Deep Reactive Ion Etching (DRIE), or in some cases by solid state laser cutting (in particular for prototyping or small series).

In the case of a nickel plate 111, regulator mechanism 7 may be obtained for instance by LIGA.

In the case of a steel or titanium plate 111, plate 111 may be locally hollowed out for instance by Wire Electric Discharge Machining (WEDM).

The constituting parts of regulator mechanism 7, formed by portions of plate 11, by will now be described in details. Some of these parts are rigid and others are elastically deformable, usually in flexion. The difference between so-called rigid parts and so-called elastic parts is their rigidity in the plane of plate 111, due to their shape and in particular to their slenderness. Slenderness may be measured for instance by the slenderness ratio (ratio of length of the part on width of the part). Parts of high slenderness are elastic (i.e. elastically deformable) and parts of low slenderness are rigid. For instance, so-called rigid parts may have a rigidity in the plane of plate 111, which is at least about 1000 times higher than the rigidity of so-called elastic parts in the plane of plate 111. Typical dimensions for the elastic connections, e.g. elastic branches 143, 145, 147 described below, include a length comprised for instance between 5 and 13 mm, and a width comprised for instance between 0.01 (10 μm) and 0.04 mm (40 μm), e.g. around 0.025 mm (25 μm).

Plate 111 forms an outer frame 112 which is fixed to a support plate 111*a* for instance by screws or similar through holes 111*b* of the plate 111. The support plate 111*a* is in turn fixed in the timepiece casing.

In the example shown on FIG. 10, plate 111 forms a closed, rigid frame 112 entirely surrounding regulator mechanism 7, but this frame could be designed otherwise and in particular could be designed to not surround or not surround totally the regulator mechanism 7.

In the example shown on FIG. 10, frame 112 may be for instance a circular ring having two rigid support arms 113 which extend inwardly from the periphery of frame 112. Support arms 113 are offset in the second direction Y and extend parallel to first direction X, in opposite ways.

Frame 112, support plate 111*a* and all other fixed parts may be referred to herein as "a support".

The regulator mechanism 7 may have two rigid, inertial regulating members 117 which are connected to the frame 112 by respective elastic suspensions 121. The elastic suspension 121 of each regulating member 117 may comprise for instance two elastic links 121 extending substantially parallel to the second direction Y, from one of the support arms 113, so that the regulating member 117 is movable in translation substantially parallel to the first direction X with respect to the support.

Figure 11:
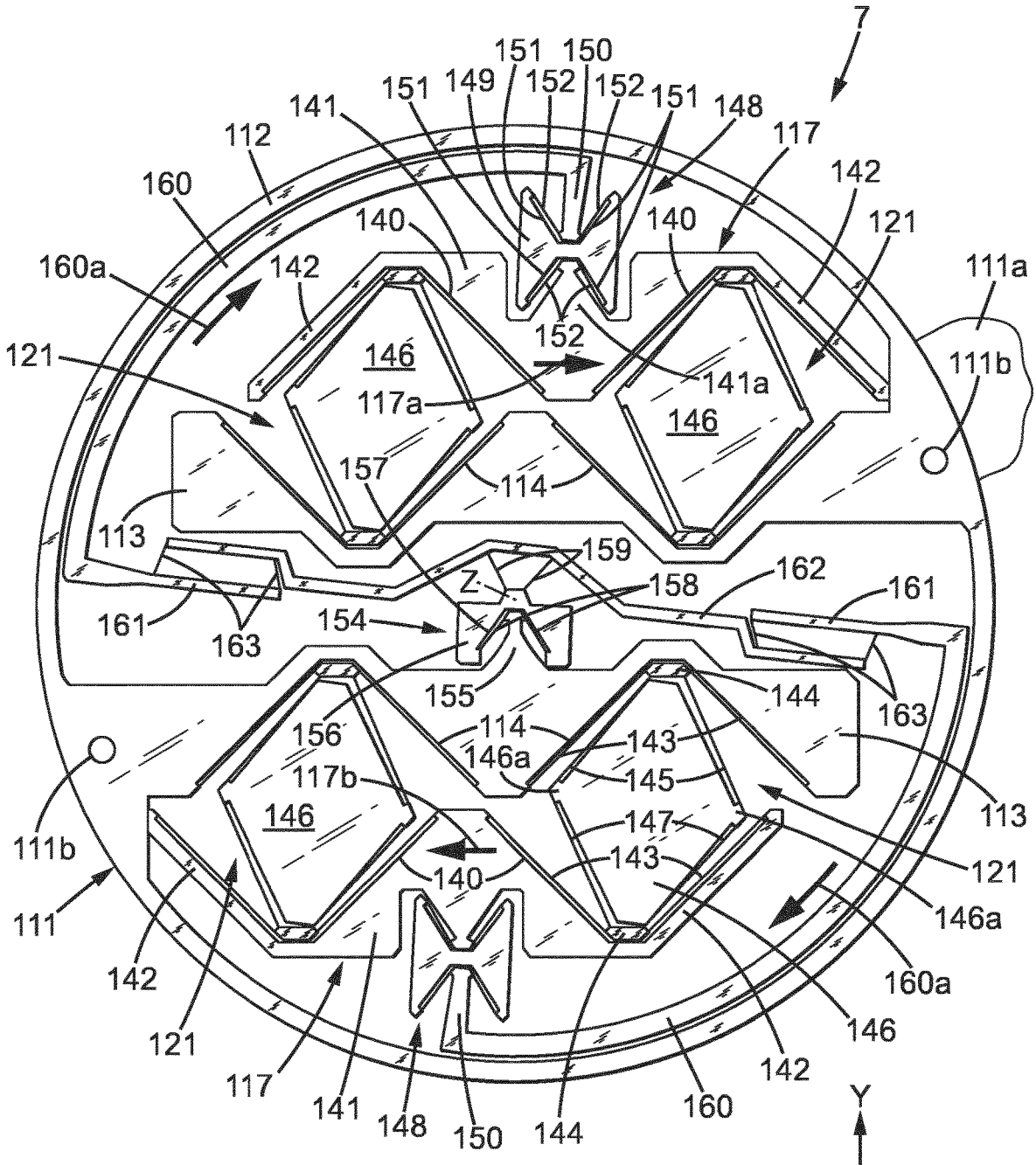
FIGS. 11-12 are views similar to FIG. 10, in two extreme positions.
Figure 12:
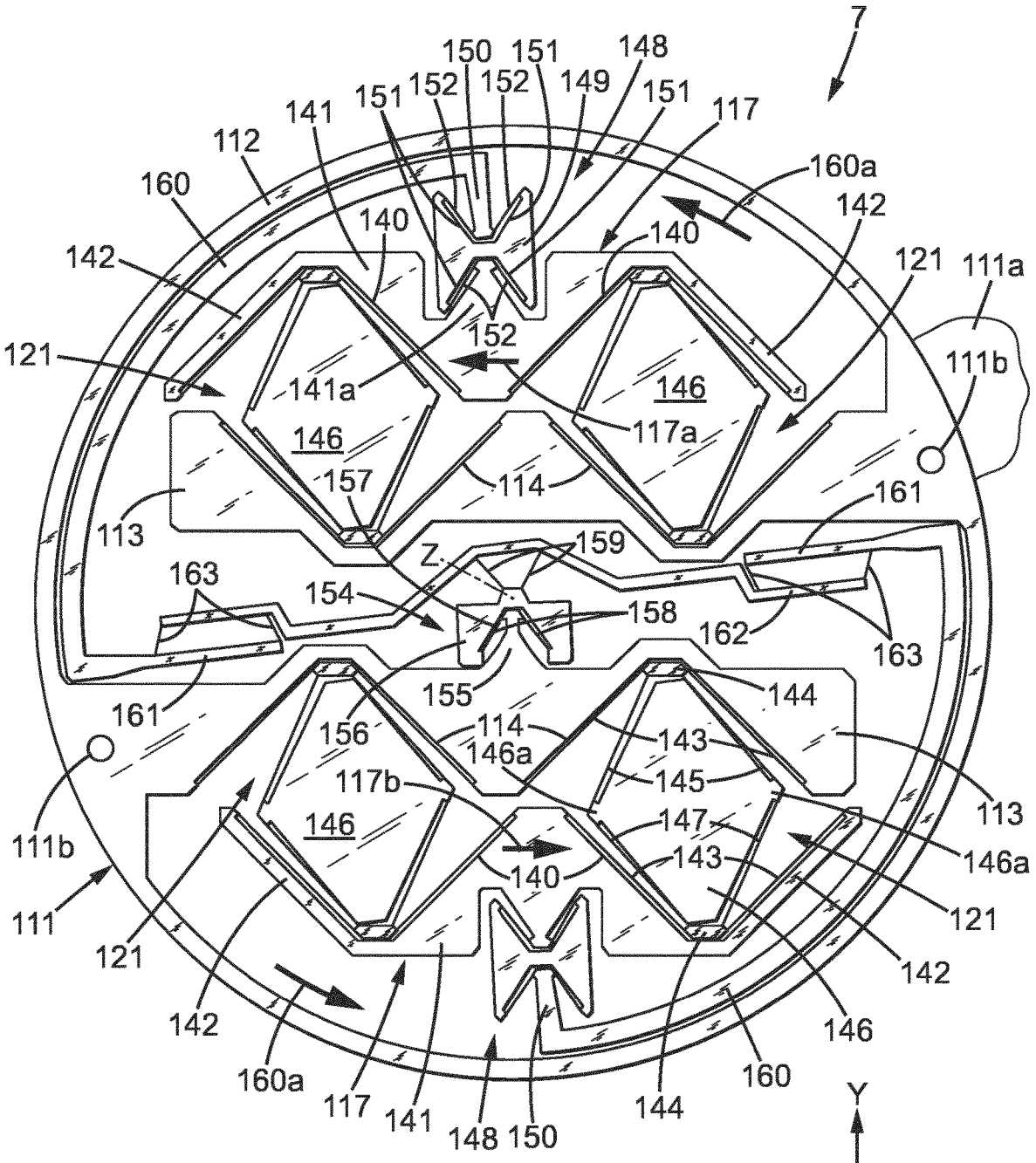

Each regulating member 117 and the elastic suspensions 121 are arranged so that said regulating member 117 oscillates in two directions from the neutral position shown on FIG. 10, according to the arrows 117*a*, 117*b* visible on FIGS. 11-12, between two extreme positions shown respectively on FIGS. 11 and 12.

The translation movement of regulating member 117 may be substantially rectilinear.

Advantageously, each regulating member 117 is mounted on the support to oscillate in circular translation, with a first amplitude of oscillation in the first direction X and a non-zero, second amplitude of oscillation in the second direction Y. Preferably, the first amplitude of oscillation is at least 10 times the second amplitude, which makes the movement substantially rectilinear.

In the embodiment of FIG. 10, each regulating member 117 may be located between one of the support arms 113 and the periphery of frame 112.

Each regulating member 117 may have a main rigid body 141 extending longitudinally substantially parallel to the first direction X, extended by two diverging rigid lateral arms 142 extending from the ends of the main body 141 toward the corresponding support arm 113. The main body 141 may be substantially triangular in shape, to form with the lateral arms 142, two substantially V-shaped cutouts 140 opening toward the corresponding support arm 113. The corresponding support arm 113 may also have two substantially V-shaped cutouts 114 in register with the cutouts 140 of the regulating member 117.

The elastic links 121 may here be elaborate elastic structures, but the invention is not limited to such elaborate structures.

In the example of FIG. 10, each elastic link 121 may include a rigid link arm 146 connected to the corresponding support arm 113 by two elastic branches 145 and to the regulating member 117 by two other elastic branches 147. Each rigid link arm 146 may extend longitudinally in the second direction Y, in the corresponding cutouts 140, 114.

For instance, each rigid link arm may be shaped as a rhomb extending longitudinally in the second direction Y between two apices (not referenced) which are close to two intermediate rigid bodies 144 located in the apices of the cutouts 114, 140. Each intermediate rigid body 144 may be elastically supported by two diverging elastic branches 143 which are disposed parallel to the edges of cutouts 114, 140. The elastic branches 143 on the side of the regulating member 117 are connected to said regulating member 117 close to the mouth of the corresponding cutout 140, and the elastic branches 143 on the side of the support arm 113 are connected to said support arm 113 close to the mouth of the corresponding cutout 114. Each link arm 146 also has two apices 146*a* aligned in the first direction X. The apices 146*a* are connected to the intermediate rigid bodies 144 respectively by two elastic branches 145 on the side of support arm 113, and respectively by two elastic branches 147 on the side of the regulating member 117. The elastic branches 143, 147 run alongside the edges of the arm link 146.

The above elastic links 121 thus extend in the second direction Y.

The regulating members 117 are connected together by a balance lever 160, 162 which is designed such that regulating members 117 have always symmetric movements in opposite directions, so as to maintain in a fixed position the center of gravity of the assembly formed by regulating members 117 and balance lever 160, 162, e.g. substantially in correspondence with an axis Z perpendicular to the first and second directions X, Y. Thanks to this balancing, the mechanism is not sensitive to shocks, accelerations or gravity applied parallel to the first direction X.

In the example of FIG. 10, the balance lever 160, 162 may include two rigid arcuate levers 160, shaped as arcs of circle centered on axis Z and disposed inside the frame 112, and a rigid intermediate lever 162 joining the two arcuate levers 160 and extending substantially diametrically with respect to axis Z.

Each arcuate lever 160 may extend between two ends formed as elbows 150, 161, which are disposed substantially radially with respect to axis Z, respectively in the second direction Y and in the first direction X. Each elbow 150 may be connected to one of the regulating members 117 by an articulation 148, and each elbow 161 may be connected to the intermediate lever 162 by any means, e.g. by an elastic connection, for instance by elastic branches 163. The intermediate lever 161 may be connected to the frame 112, for instance to one of the support arms 113, by an articulation 154 enabling the whole balance lever 160, 162 to pivot around axis Z.

In the example of FIG. 10, each articulation 148 may include an intermediate rigid body 149 having two opposed V-shaped cutouts 151. A respective shoulder 150 of one of the arcuate levers 160 penetrate in one of the cutouts 151, while a protrusion 141*a* of the corresponding regulating member 117. The respective free ends of the elbow 150 and of the protrusion 141*a* may be connected by elastic branches 152 to the intermediate body 149 at the mouth of the V-shaped cutouts 151.

The articulation 154 may be formed similarly and include an intermediate rigid body 156 having a V-shaped cutout 157 in which penetrate a protrusion 155 of the one of the support arms 113. The free end of the protrusion 155 may be connected by elastic branches 158 to the intermediate body 156 at the mouth of the V-shaped cutout 157. The intermediate body 156 may also be connected to the center of intermediate lever 162 by elastic branches 159.

Elastic branches 152, 158, 159, 163 may have similar widths as elastic branches 143, 145, 147.

As shown on FIGS. 11, 12, the translational oscillations of regulating members 117 are transformed into a pivoting movement around axis Z by the balance lever 160, 162.

Figure 13:
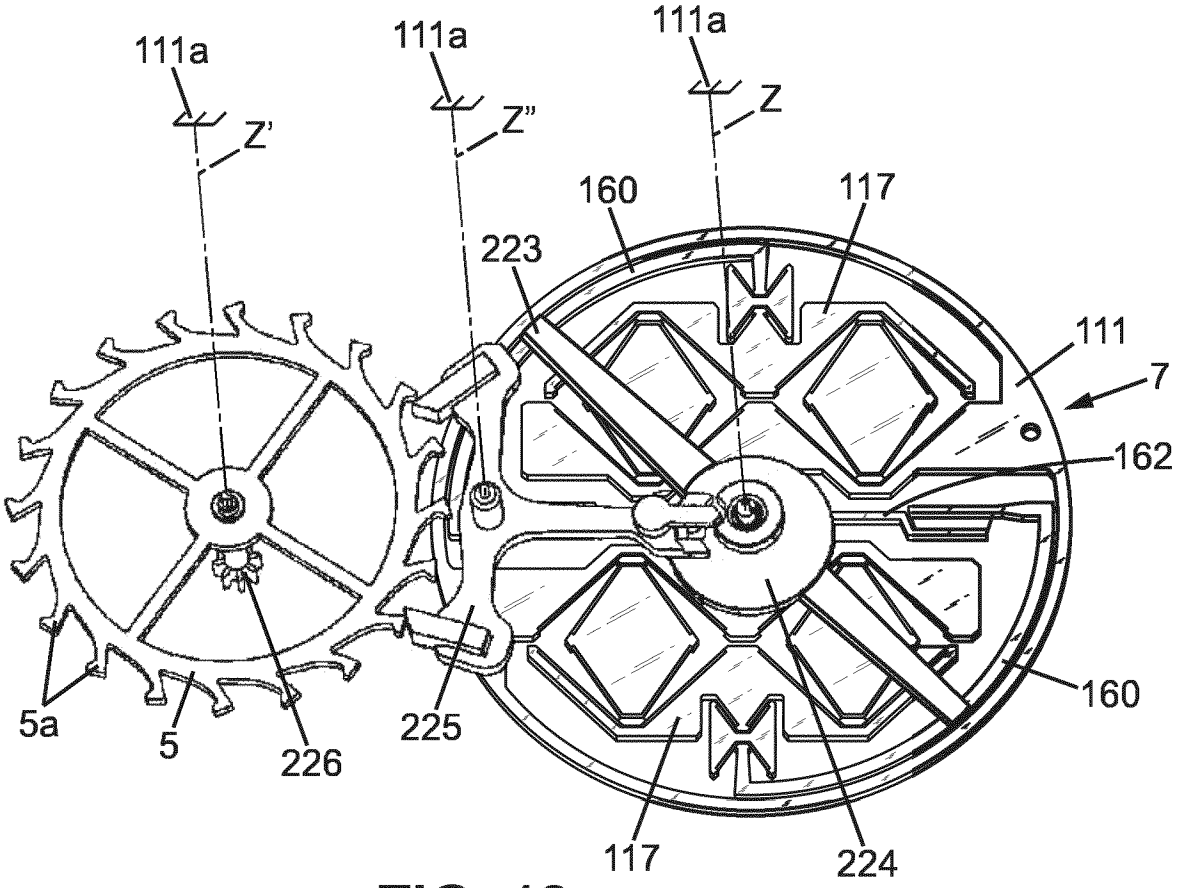
FIG. 13 is a schematic perspective view showing part of a timepiece movement including the regulator mechanism of FIG. 10.

As shown schematically in FIG. 13, regulator 7 may be assembled for instance to a blocking mechanism 6 in the form of a classical escapement mechanism, here a so-called Swiss-lever escapement or Swiss-anchor escapement. Just as an illustrative example, the balance lever 161, 162 may be connected to a fitting 223 bearing an impulse roller 224 cooperating with a Swiss anchor 225 which itself cooperates with the energy distribution wheel 5 in the form of an escapement wheel. The escapement wheel 5 is connected to a pinion 226 meshing with one of the pinions of transmission 3. Both escapement wheel 5 and pinion 226 rotate on a rotation axis Z' (fixed with respect to the support plate 111*a*) parallel to axis Z, and the Swiss anchor 225 pivots in alternating movements on a pivoting axis Z" (also fixed with respect to the support plate 111*a*) parallel to axis Z. The structure and operation of these elements is well known in the field of clock making and will not be detailed. Other blocking mechanisms 6 and energy distribution wheels 5 are possible.

The invention claimed is:

1. A timepiece movement having a timepiece regulator and a blocking mechanism, said timepiece regulator comprising at least one inertial regulating member which is mounted on a support by an elastic suspension so as to be able to oscillate, wherein the regulating member is mounted on the support to oscillate in translation, along a main direction of translation, said blocking mechanism having a blocking member being controlled by the regulating member to be able to regularly and alternatively hold and release a movable energy distribution member so that said energy distribution member moves by steps, said blocking mechanism being further adapted to regularly release energy to the regulating member for maintaining oscillation of said regulating member, said blocking member being connected to said regulating member by at least one first elastic link, wherein said elastic suspension includes at least two second elastic links extending substantially in a second direction substantially perpendicular to the main direction of translation, each second elastic link extending between a first end unitary with the support and a second end unitary with the inertial regulating member.

2. The timepiece movement according to claim 1, wherein the regulating member is mounted on the support to oscillate in substantially rectilinear translation.

3. The timepiece movement according to claim 1, wherein the regulating member is mounted on the support to oscillate in circular translation, with a first amplitude of oscillation in the main direction of translation and a non-zero, second amplitude of oscillation in said second direction, the first amplitude being larger than the second amplitude.

4. The timepiece movement according to claim 3, wherein the first amplitude of oscillation is at least 10 times larger than the second amplitude.

5. A timepiece regulator according to claim 1, comprising two inertial regulating members which are linked together such that said regulating members always have symmetrical an opposed movements in the main direction of translation.

6. A timepiece regulator according to claim 5, wherein the two inertial regulating members are linked together by a balance lever which is pivotally mounted with respect to the support.

7. The timepiece movement according to claim 1, wherein the timepiece regulator and blocking member forma monolithic part made in a single plate.

8. The timepiece movement according to claim 1, further comprising said movable energy distribution member, said movable energy distribution member being a rotative wheel having external teeth adapted to cooperate with said blocking member.

9. A timepiece having a timepiece movement according to claim 1.

10. The timepiece movement according to claim 1, wherein said blocking member is connected to said support by at least one elastic branch extending substantially in the first direction and adapted to guide said blocking member for movement in the second direction.

11. The timepiece movement according to claim 10, said movable energy distribution member is a rotative wheel having external teeth and wherein said blocking member includes two spaced-apart stop members which are substantially opposed in the second direction and which are adapted to, in turn, stop and release said external teeth of the rotative wheel.

12. The timepiece movement according to claim 1, wherein said blocking member is connected to said regulating member by two first elastic links extending substantially in the second direction.

13. The timepiece movement according to claim 12, wherein said blocking member is connected to said support by two elastic branches extending substantially in the first direction and adapted to guide said blocking member for movement in the second direction.

* * * * *